US005600406A

United States Patent [19]

Aikawa et al.

[11] Patent Number: 5,600,406

[45] Date of Patent: Feb. 4, 1997

[54] FIXING TEMPERATURE CONTROL DEVICE

[75] Inventors: Yukihiro Aikawa; Satoshi Ishii; Hiroyuki Sadamori; Tsutomu Sugaya; Junichi Hirobe, all of Osaka, Japan

[73] Assignee: Mita Industrial Co., Ltd., Osaka, Japan

[21] Appl. No.: 305,316

[22] Filed: Sep. 15, 1994

[30] Foreign Application Priority Data

| | | | |
|---|---|---|---|
| Oct. 19, 1993 | [JP] | Japan | 5-261419 |
| Oct. 19, 1993 | [JP] | Japan | 5-261420 |
| Oct. 19, 1993 | [JP] | Japan | 5-261421 |
| Oct. 19, 1993 | [JP] | Japan | 5-261422 |
| Nov. 30, 1993 | [JP] | Japan | 5-300447 |

[51] Int. Cl.[6] ..... G03G 15/20

[52] U.S. Cl. ..... 399/70; 399/328

[58] Field of Search ..... 355/208, 285, 355/290; 219/216

[56] References Cited

U.S. PATENT DOCUMENTS

| | | | |
|---|---|---|---|
| 4,006,985 | 2/1977 | Hutner | 355/285 X |
| 4,348,102 | 9/1982 | Sessink | 355/285 |
| 4,425,494 | 1/1984 | Enomoto et al. | 219/216 |
| 4,609,278 | 9/1986 | Taniguchi | 355/285 |
| 5,206,694 | 4/1993 | Ohira et al. | 355/290 |
| 5,220,389 | 6/1993 | Kishimoto et al. | 355/285 |
| 5,241,349 | 8/1993 | Nagasaka | 355/285 |
| 5,321,479 | 6/1994 | Yoshida et al. | 355/285 |
| 5,331,384 | 7/1994 | Otsuka | 355/290 |

FOREIGN PATENT DOCUMENTS

| | | |
|---|---|---|
| 374738 | 6/1990 | European Pat. Off. . |

*Primary Examiner*—Nestor R. Ramirez

*Attorney, Agent, or Firm*—Beveridge, DeGrandi, Weilacher & Young, L.L.P.

[57] ABSTRACT

A fixing temperature control device according to the present invention is applied to a copying machine. A control section has a warm-up control mode and a normal control mode. In the warm-up control mode, energization to a heater is started in response to the start of copying, while being stopped at the time point where a temperature detected by a heat roller temperature detecting sensor reaches a first off temperature. In the normal control mode, on-off control of the energization to the heater is carried out utilizing a predetermined control temperature as a target subsequently to the termination of the warm-up control mode. The predetermined control temperature is corrected by adding a prescribed correction amount to a reference control temperature. It is preferable that the required correction amount includes i) an initial correction amount added in the early stages of processing in the normal control mode, ii) a correction amount at the time of passing paper sheets added when paper sheets pass between a heat roller and a pressure roller in a fixing device, and iii) an environmental correction amount added depending on an environmental temperature.

20 Claims, 16 Drawing Sheets $T_2$ : FIRST OFF TEMPERATURE

Tc : CONTROL TEMPERATURE $T_2$ : FIRST OFF TEMPERATURE $T_1$ : PREDETERMINED INITIALLY DETECTED TEMPERATURE
Tc : CONTROL TEMPERATURE
to : ATMOSPHERIC TEMPERATURE
$D_1(n)$ : INITIAL CORRECTION AMOUNT
$D_2$ : CORRECTION AMOUNT AT TIME OF PASSING PAPER SHEETS
$D_3(to)$ : ENVIRONMENTAL CORRECTION AMOUNT

Tc : CONTROL TEMPERATURE

FIXING TEMPERATURE CONTROL DEVICE

CROSS REFERENCE TO RELATED APPLICATION

This application claims priority benefits under 35 USC §119 of Japanese Patent Application Serial Nos. 5-261419, 5-261420, 5-261421, 5-261422 and 5-300447, the disclosures of which are incorporated by reference.

BACKGROUND OF THE INVENTION

1. Field of the Invention

The present invention relates to a fixing temperature control device which is applied to a fixing device in an image forming apparatus such as an electrostatic copying machine or a facsimile for carrying out on-off control of a heater for heating a fixing device.

2. Description of the Related Art

Generally in an image forming apparatus, for example, a copying machine, an electrostatic latent image formed on a photosensitive drum is developed into a toner image and the toner image is transferred onto paper sheets, after which the transferred toner image is heated and fixed by a fixing device. The fixing device comprises a pressure roller and a heat roller heated by a heater for heating and fixing toner particles to the paper sheets passing between both the rollers.

In order to heat and fix toner particles, the temperature of the fixing device must reach a predetermined temperature. If the temperature of the fixing device is lower than the predetermined temperature, toner particles are insufficiently fixed. If the temperature of the fixing device is higher than the predetermined temperature, so-called high-temperature offset occurs. The high-temperature offset is when that toner particles which enter a molten state due to high temperatures remain on the pressure roller or the like and are transferred onto unnecessary portions of the paper sheets. Specific examples include duplicating.

Conventionally in the copying machine or the like, energization control (on-off control) is continuously carried out with respect to a heater for heating a heat roller from the time when a power supply switch is turned on to the time when it is turned off, to warm the fixing device to a predetermined temperature.

However, it is not preferable in terms of energy saving to warm the fixing device when copies are not made.

SUMMARY OF THE INVENTION

The present invention has been made in view of the foregoing problems and has for its object to provide a fixing temperature control device capable of heating a fixing device only at a required time when an image is formed to achieve energy saving.

In order to solve the foregoing problems, according to one embodiment of the present invention, there is provided a fixing temperature control device comprising a fixing device in an image forming apparatus which comprises a pressure roller and a heat roller heated by a heater which heats and fixes toner particles to paper sheets passing between both the rollers, heat roller temperature detecting means for detecting the temperature of the heat roller, and energization control means for turning the heater on and off. The energization control means is set to a warm-up control mode in which processing is started by turning the heater on in response to input of an image formation start signal, and terminated by turning the heater off at the time point where a temperature detected by the heat roller temperature detecting means reaches a first off temperature, and a normal control mode in which processing having a predetermined control temperature as a target is started on the basis of the temperature detected by the heat roller temperature detecting means in response to termination of the processing in the warm-up control mode, and is terminated in a state where the heater is turned off in response to input of an image formation termination signal.

According to the present embodiment, if the image formation start signal is inputted, the energization control means enters the warm-up control mode, in which the energization to the heater is started to warm up the fixing device. If the temperature detected by the heat roller temperature detecting means reaches the first off temperature by the warm-up, the processing in the normal control mode is started, in which on-off control having a predetermined control temperature as a target is carried out. In the normal control mode, the paper sheets pass between the heat roller and the pressure roller in the fixing device, to fix toner particles. Thereafter, if the image formation termination signal is inputted, the processing in the normal control mode is terminated in a state where the heater is turned off. Only at the required time when an image is formed, is the fixing device warmed, thereby to achieve energy saving.

In a preferred embodiment of the present invention, the above described predetermined control temperature is set by adding a required correction amount to a predetermined reference control temperature.

In another preferred embodiment of the present invention, the above described required correction amount includes an initial correction amount added in the normal control mode. According to the present embodiment, the following function and effect are obtained. Specifically, the inventors of the present application have considered that in the early stages of the processing in the normal control mode, the pressure roller has not been sufficiently warmed yet even if the heat roller heated by the heater reaches a predetermined temperature, causing toner particles to be insufficiently fixed. The control temperature is relatively increased by adding the initial correction amount in the early stages of the processing, thereby to prevent the insufficient fixing.

In still another preferred embodiment of the present invention, the above described required correction amount includes a correction amount at the time of passing paper sheets which is added with at least the time when the paper sheets pass between both the rollers included. According to the present embodiment, the following function and effect are obtained. Specifically, it is preferable that the time required for the warm-up is as short as possible. Assuming a case where the heat capacity of the heat roller is set small, for example, the heat of the pressure roller is removed by the paper sheets passing, thereby causing the possibility of the insufficient fixing in the rear ends of the paper sheets. Therefore, it is considered that the control temperature is always made high. In such a case, high-temperature offset occurs in the front ends of the paper sheets. On the other hand, in the present embodiment, the control temperature is made relatively high only when the paper sheets pass. When the front ends of the paper sheets pass, therefore, the temperature of the heat roller becomes low, thereby to make it possible to prevent the high-temperature offset because the control temperature is set relatively low until the time when the paper sheets pass. On the other hand, when the rear ends of the paper sheets pass, the temperature of the heat roller becomes high, thereby to make it possible to prevent the insufficient fixing.

In yet still another preferred embodiment, the present invention further comprises environmental temperature detecting means for detecting an environmental temperature at which the above described fixing device is placed, and the above described required correction amount includes an environmental correction amount added depending on the environmental temperature detected by the environmental temperature detecting means. According to the present embodiment, the following function and effect are obtained. Specifically, assuming a case where the heat capacity of the heat roller is relatively decreased so as to shorten the warm-up time, there is a possibility that toner particles are insufficiently fixed when temperature is low, like in winter, and in the early stages of copying. If the control temperature is set high so as to prevent this possibility, there is a possibility that high-temperature offset occurs when the temperature is high, like in summer, and when copying is repeated a lot of times. The inventors of the present application have considered that the temperature of the paper sheets are low so that the amount of heat removed from the pressure roller by the paper sheets is large when an atmospheric temperature is low, causing the insufficient fixing, while being high so that the amount of heat removed from the pressure roller by the paper sheets is small when the atmospheric temperature is high, causing the high-temperature offset. Therefore, the control temperature is set in consideration of the environmental temperature at which the fixing device is placed, to carry out stable temperature control. Therefore, it is possible to prevent the high-temperature offset and the insufficient fixing which are caused by the environmental temperature.

In a further preferred embodiment of the present invention, the above described first off temperature is set lower than the above described control temperature by a predetermined amount. According to the present embodiment, the following function and effect are obtained. Specifically, when the temperature of the fixing device is rapidly raised to the control temperature by the warm-up, the amount of overshoot toward the temperature rise is large and consequently, the amount of overshoot toward the temperature drop becomes large as a reaction after the first time the heater was turned off. At this time, when the paper sheets reach the fixing device, toner particles may be insufficiently fixed in the rear ends of the paper sheets. On the other hand, according to the present embodiment, the amount of overshoot toward the temperature rise can be decreased and consequently, the amount of overshoot toward the temperature drop can be decreased because the first off temperature is set lower than the control temperature. Therefore, it is possible to restrain variations in temperature to introduce the temperature of the heat roller into a desired temperature region, thereby to make it possible to prevent both high-temperature offset and wrinkle which are liable to be caused in the front ends of the paper sheets and the insufficient fixing which is liable to be caused in the rear ends of the paper sheets in the first image formation.

In accordance with a further preferred embodiment of the present invention, in the above described normal control mode, the heater is turned on under the condition that the detected temperature of the heat roller is lower than the above described control temperature when a predetermined time has elapsed since the heater was turned off, while the heater is turned off if either a predetermined time has elapsed since the heater was turned on or the detected temperature of the heat roller is higher than the control temperature.

According to the present embodiment, in the normal control mode, intermittent control using a combination of the elapsed time and the control temperature is carried out. In a state where the variations in temperature are further restrained, therefore, the temperature can be introduced into a desired temperature region. Consequently, in the first image formation, it is possible to reliably prevent both high-temperature offset and wrinkle which are liable to be produced in the front ends of the paper sheets and insufficient fixing which is liable to be caused in the rear ends of the paper sheets.

In a still further preferred embodiment of the present invention, the fixing temperature control device according to the present invention is characterized by further comprising rotating and driving means for rotating and driving a group of a plurality of paper conveying rollers each comprising the pressure roller and the heat roller, environmental temperature detecting means for detecting an environmental temperature at which the fixing device is placed, and a rotational speed adjusting section for adjusting the rotational speed of the rotating and driving means depending on the environmental temperature detected by the environmental temperature detecting means.

According to the present embodiment, the speed at which paper sheets pass is adjusted depending on the atmospheric temperature to adjust the amount of heat per unit time removed by the paper sheets, thereby to make it possible to maintain a balance with the amount of heat per unit time supplied from the heater to carry out stable temperature control. Consequently, it is possible to prevent high-temperature offset and insufficient fixing which are caused by the environmental temperature.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

The embodiments will be described in detail with reference to the attached drawings.

First Embodiment

Figure 1:
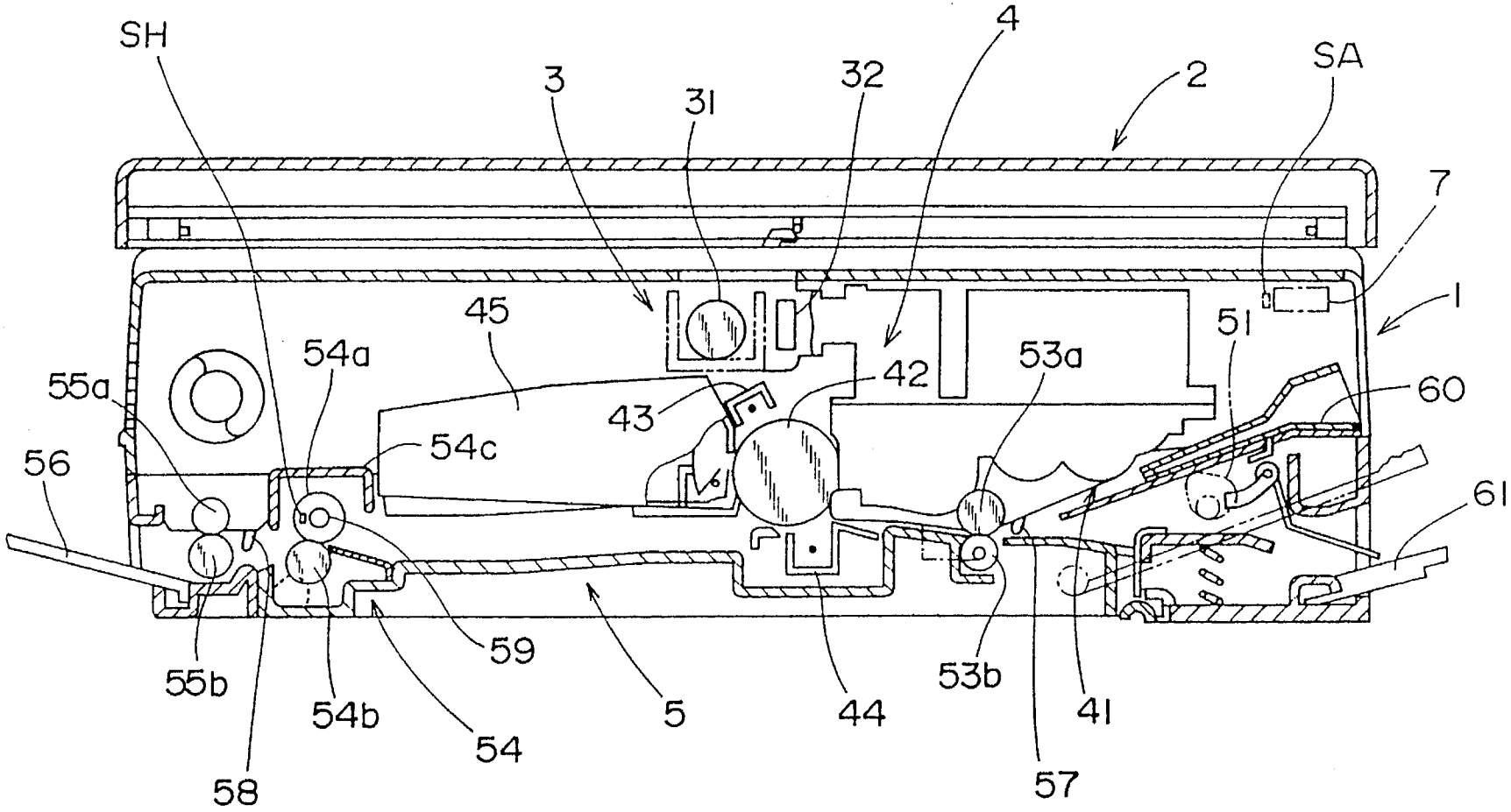
FIG. 1 is a conceptual diagram showing the internal construction of a copying machine comprising a fixing temperature control device according to one embodiment of the present invention.

Referring to FIGS. 1 to 8, description is made of one embodiment of the present invention. Referring to FIG. 1, a copying machine comprises (1) an original platen 2 for moving an original put on a transparent platen along the upper surface of the main body of the copying machine 1 in a state where the original is pressed by an original cover, (2) an optical system 3 for illuminating the original moved by the original platen 2 to introduce light reflected from the original into a photosensitive drum 42, (3) an image forming section 4 for developing an electrostatic latent image formed on the photosensitive drum 42 into a toner image by a developing device 41 and then, transferring the toner image onto paper sheets, and (4) a paper conveying section 5 comprising a fixing device 54 for heating and fixing the toner image transferred onto the paper sheets for discharging the paper sheets into a discharge tray 56 inside the main body of the copying machine 1 through the image forming section 4 from a paper feeding tray 61, and the like.

An operating section (not shown) in which switches such as a copying starting switch are disposed is provided on the upper surface of the main body of the copying machine 1.

The optical system 3 comprises a fluorescent lamp 31 serving as a light source for illuminating the original moved on the original platen 2 and a plurality of image-forming lenses 32 arranged in a direction orthogonal to the direction in which the original is moved for focusing the reflected light from the original on the photosensitive drum 42.

In the image forming section 4, a charging corona discharger 43, the developing device 41, a transferring corona discharger 44 and a cleaning device 45 are disposed in this order around the photosensitive drum 42. This image forming section 4 is so adapted that an original image is formed on an outer peripheral surface of the photosensitive drum 42 uniformly charged by the charging corona discharger 43 to form an electrostatic latent image, after which the electrostatic latent image is developed into a toner image by the developing device 41, the toner image is transferred onto the paper sheets by the transferring corona discharger 44, and remaining toner particles are recovered by the cleaning device 45.

The paper conveying section 5 comprises a paper feeding roller 51 which is semicircular in cross section for pulling out paper sheets one at a time from the paper feeding tray 61, registration rollers **53*a* and 53*b*, on which the front ends of the paper sheets from a manual paper feeding section 60 or the paper feeding tray 61 abut, for causing the paper sheets to temporarily wait, a heat roller 54*a* and a pressure roller 54*b* included in the fixing device 54 for fixing the toner image transferred onto the paper sheets, and a pair of discharge rollers 55*a* and 55*b***.

The paper conveying section 5 further comprises a paper feeding detecting switch 57, a paper discharge detecting switch 58, a heat roller temperature detecting sensor SH and an atmospheric temperature detecting sensor SA. The paper feeding detecting switch 57 comprises a limit switch disposed on the upstream side in the direction of paper conveyance of the registration rollers **53*a* and 53*b*, and the paper discharge detecting switch 58 comprises a limit switch disposed on the upstream side in the direction of paper conveyance of the paper discharge rollers 55*a* and 55*b*. In addition, the heat roller temperature detecting sensor SH comprises a thermistor disposed in a predetermined portion of the heat roller 54*a* for detecting the temperature of the heat roller 54*a*. The atmospheric temperature detecting sensor SA comprises a thermistor disposed in a predetermined position which is not affected by heat inside the main body of the copying machine 1 for detecting an environmental temperature (atmospheric temperature) at which the fixing device 54** is placed.

The fixing device 54 heats and fixes toner particles to the paper sheets passing between the pressure roller **54*b* and the heat roller 54*a* heated by a heater 59. The heat roller 54*a* is composed of a roller made of a metal, contains the above described heater 59 composed of a cartridge heater, and is heated by the heater 59. The pressure roller 54*b* is composed of a rubber roller, is supported movably in the radial direction, and is urged by a predetermined urging force toward the heat roller 54*a*** using a spring member (not shown).

Figure 2:
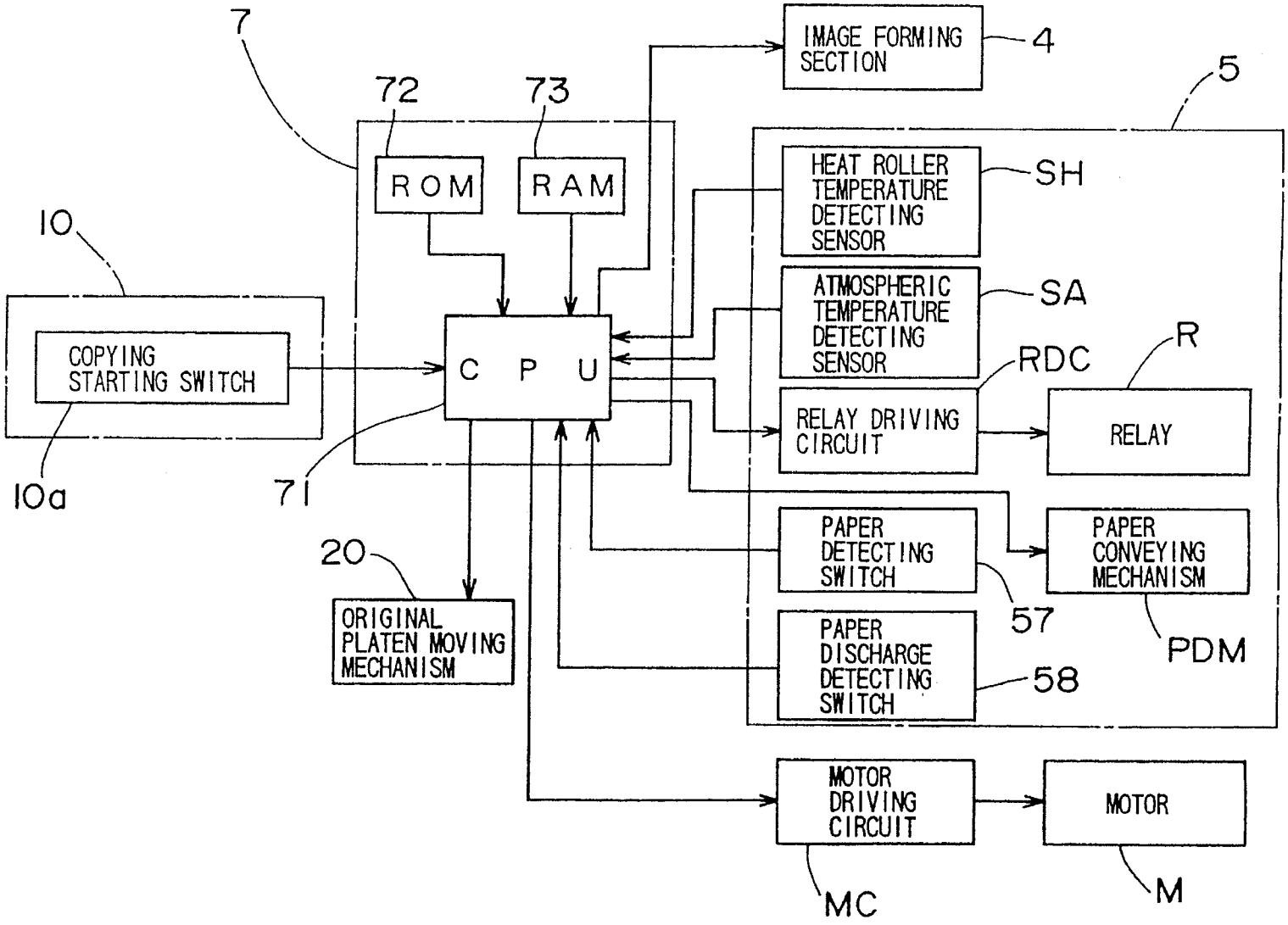
FIG. 2 is a block diagram showing the electrical construction of the copying machine.

Referring to FIG. 2, a control section 7 for controlling operations of respective sections of the copying machine comprises a CPU 71, a ROM 72 storing programs executed by the CPU 71, and a RAM 73 used as, for example, a work area of the CPU 71. An operating section 10 provided on the upper surface of the main body of the copying machine 1 and comprising a copying starting switch **10*a*, the image forming section 4, the paper conveying section 5, a motor driving circuit MC and an original platen moving mechanism 20 are connected to the CPU 71. The motor driving circuit MC drives a motor M serving as a driving source for driving the original platen 2, the image forming section 4, the paper conveying section 5 and the like. The original platen moving mechanism 20, the image forming section 4** and a paper conveying mechanism PDM are synchronously driven by the motor M.

The paper conveying section 5 comprises a relay driving circuit RDC for driving a relay R for turning the heater 59 on and off and the paper conveying mechanism PDM for conveying paper sheets by a driving force of the motor M in addition to the paper detecting switch 57, the paper discharge detecting switch 58, the heat roller temperature detecting sensor SH and the atmospheric temperature detecting sensor SA, which are connected to the CPU 71.

The CPU 71 carries out on-off control of the heater 59 in the fixing device 54 on the basis of a program read from the ROM 72. Set as a control mode at this time are (1) a warm-up control mode for continuously energizing the heater 59 in response to a copying start signal to raise the temperature of the heat roller 54*a* to a predetermined temperature (a first off temperature $T_2$ as described later) in one operation and (2) a normal control mode for intermittently energizing the heater 59 on the basis of the elapsed time or the like to hold the temperature of the heat roller 54*a* at a predetermined control temperature after completion of the warm-up.

At the time of the normal control mode, (1) initial correction in which an initial correction amount is added to a reference control temperature in the early stages of processing in the normal control mode, (2) a correction at the time of passing paper sheets in which a correction amount at the time of passing paper sheets is added to the reference control temperature only when paper sheets pass, and (3) an environmental correction in which an atmosphere-dependent correction amount is added to the reference control temperature depending on the environmental temperature (atmospheric temperature) at which the fixing device 54 is placed are made. At the time of the initial correction, the initial correction amount is gradually decreased. In addition, the initial correction is made under the condition that an initially detected temperature of the heat roller 54*a* before starting processing in the warm-up control mode is lower than a predetermined initially detected temperature.

Figure 3:
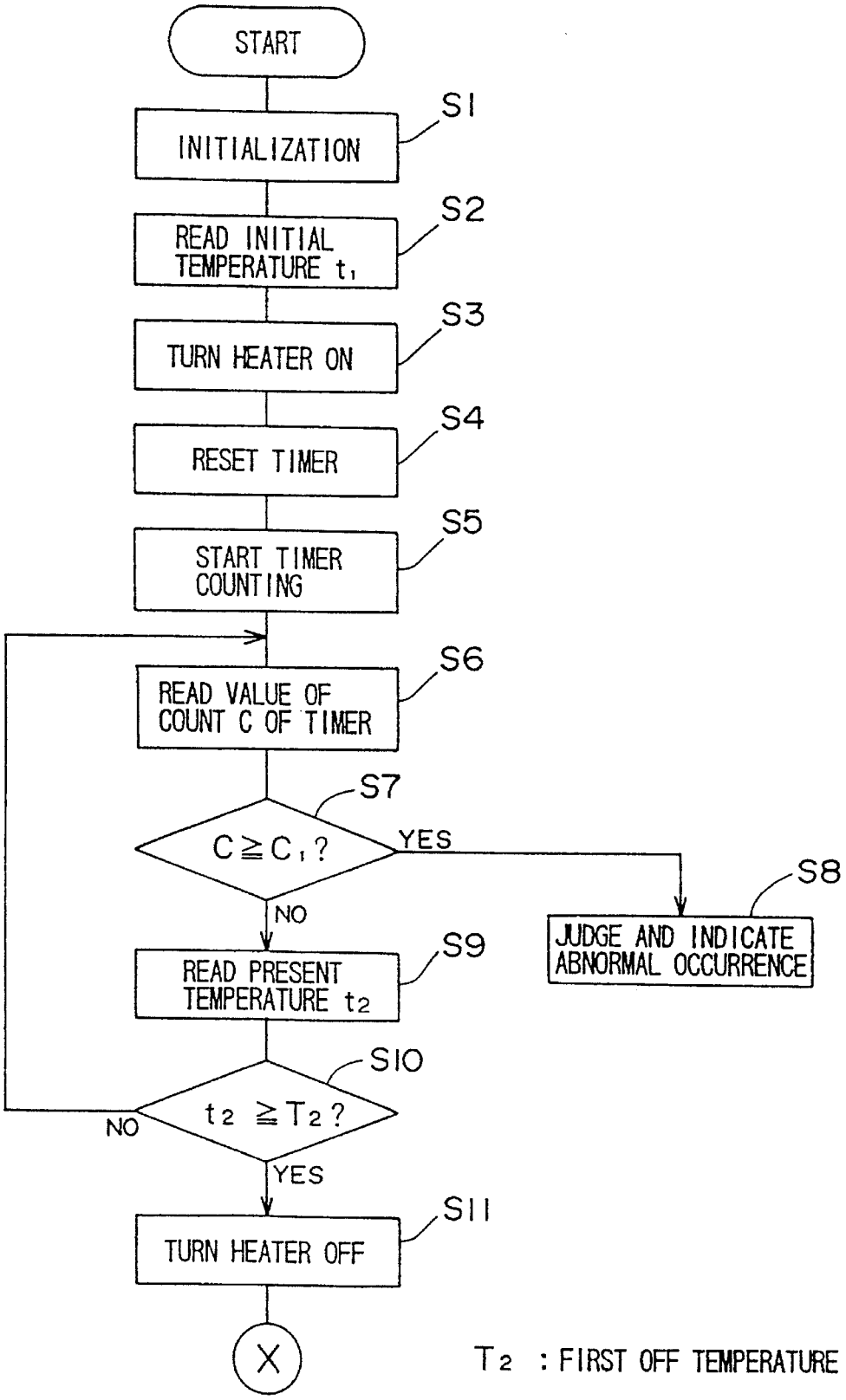
FIG. 3 is a flow chart showing operations in a warm-up control mode out of operations for temperature control of a fixing device.
Figure 4:
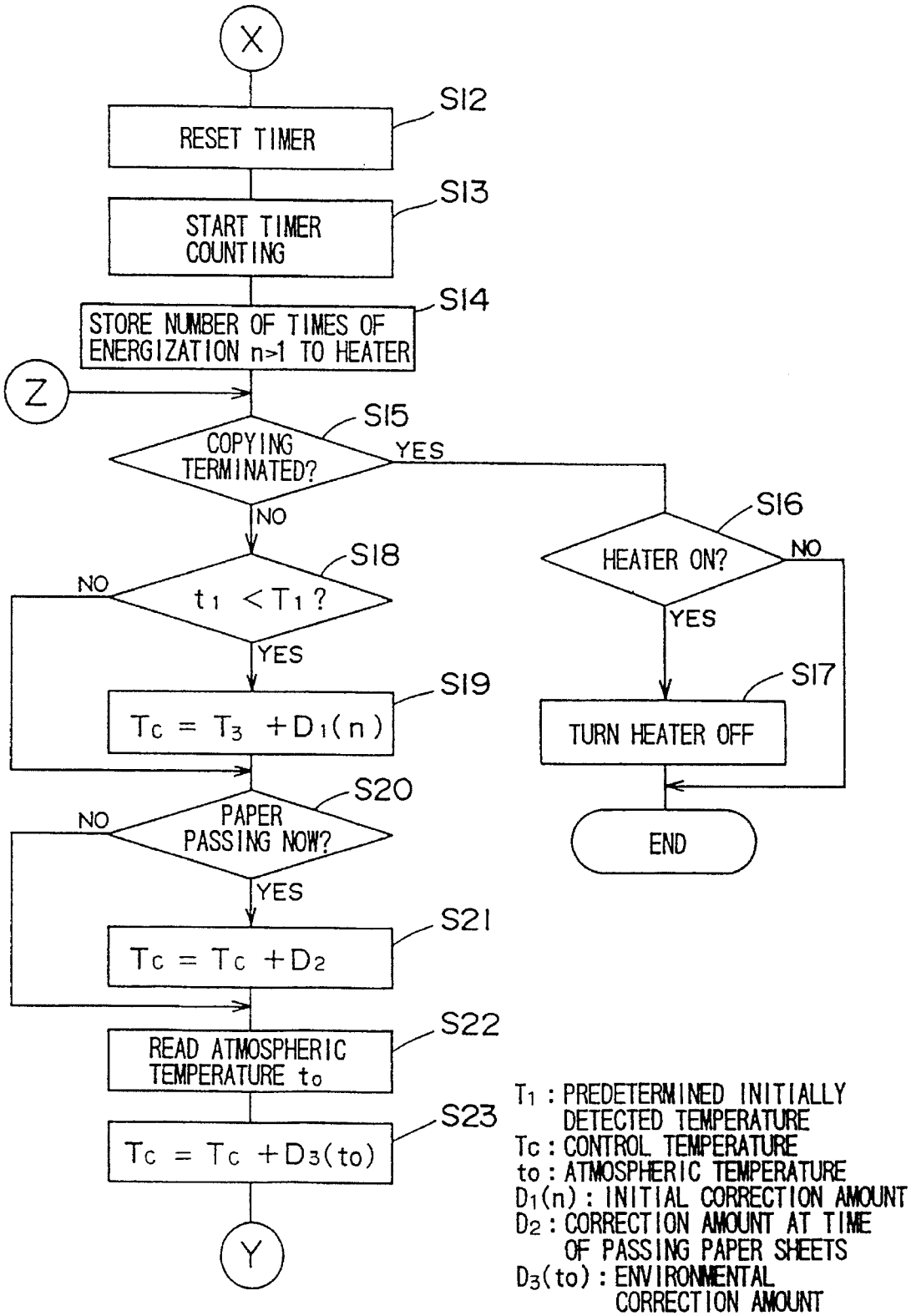
FIG. 4 is a flow chart showing operations in a normal control mode out of the operations for temperature control of the fixing device.
Figure 5:
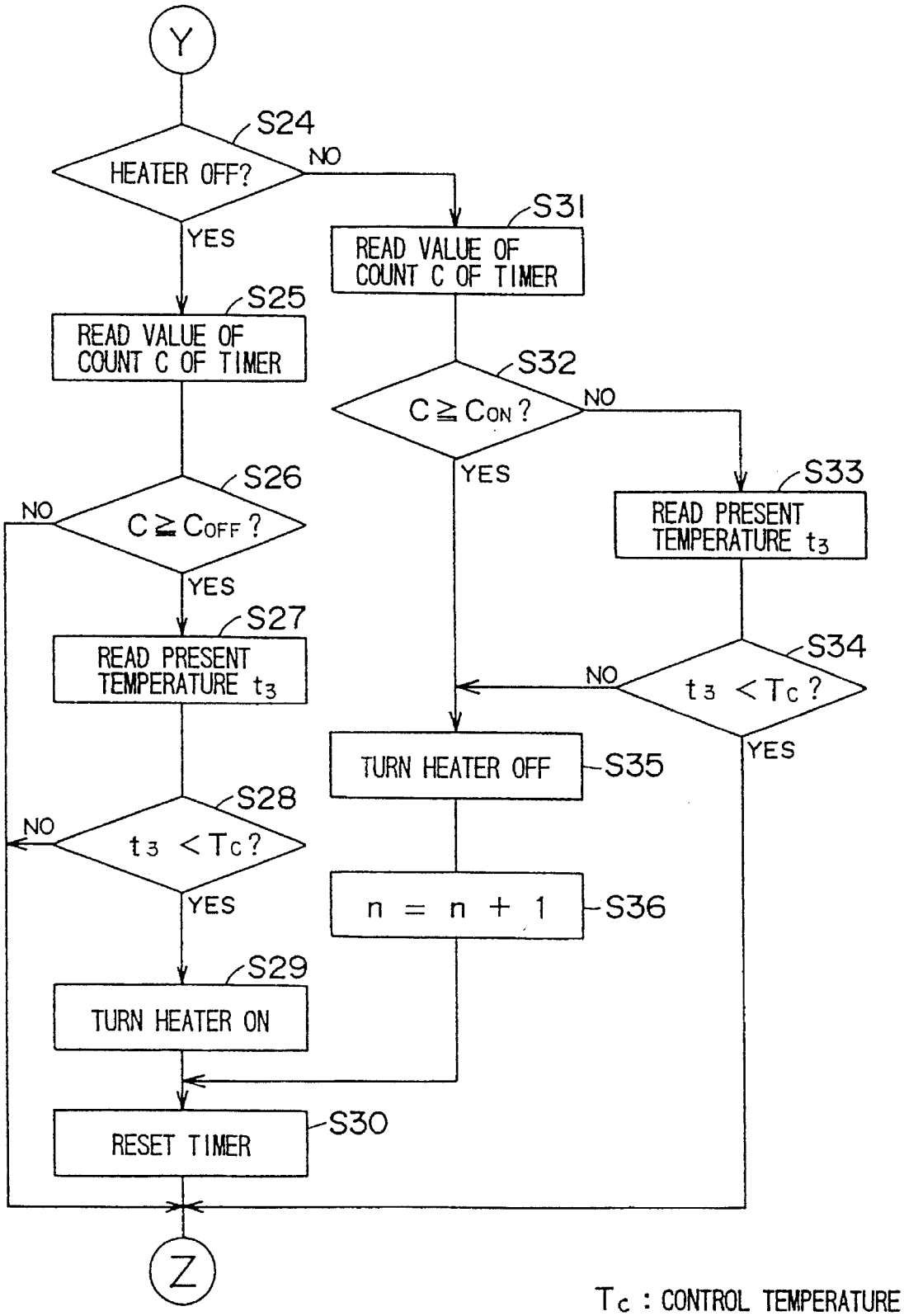
FIG. 5 is a flow chart showing operations in the normal control mode out of the operations for temperature control of the fixing device, which is a continuation of the flow chart of FIG. 4.
Figure 6:
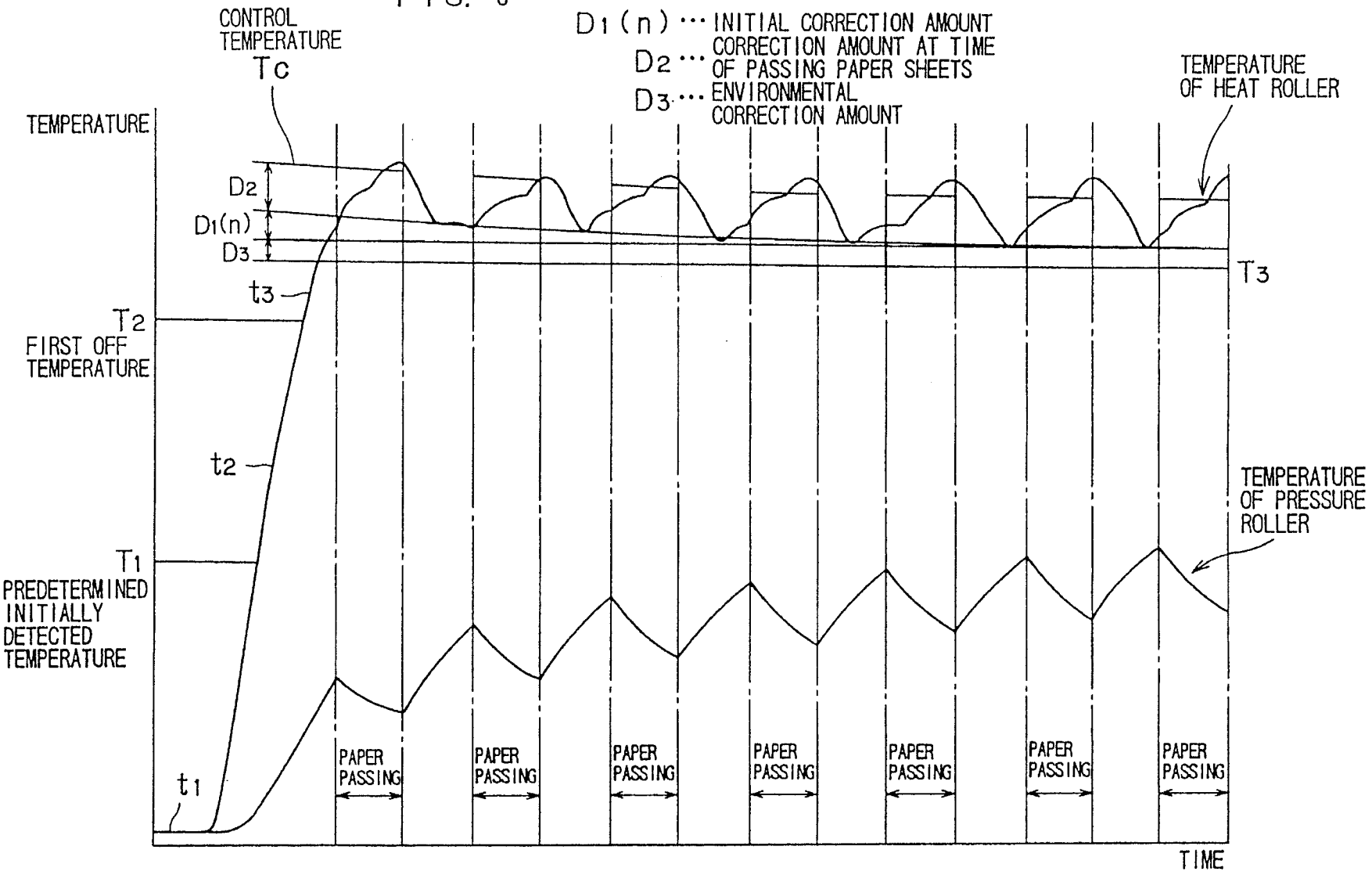
FIG. 6 is a diagram showing the change with time of the temperatures of a heat roller and a pressure roller.
Figure 7:
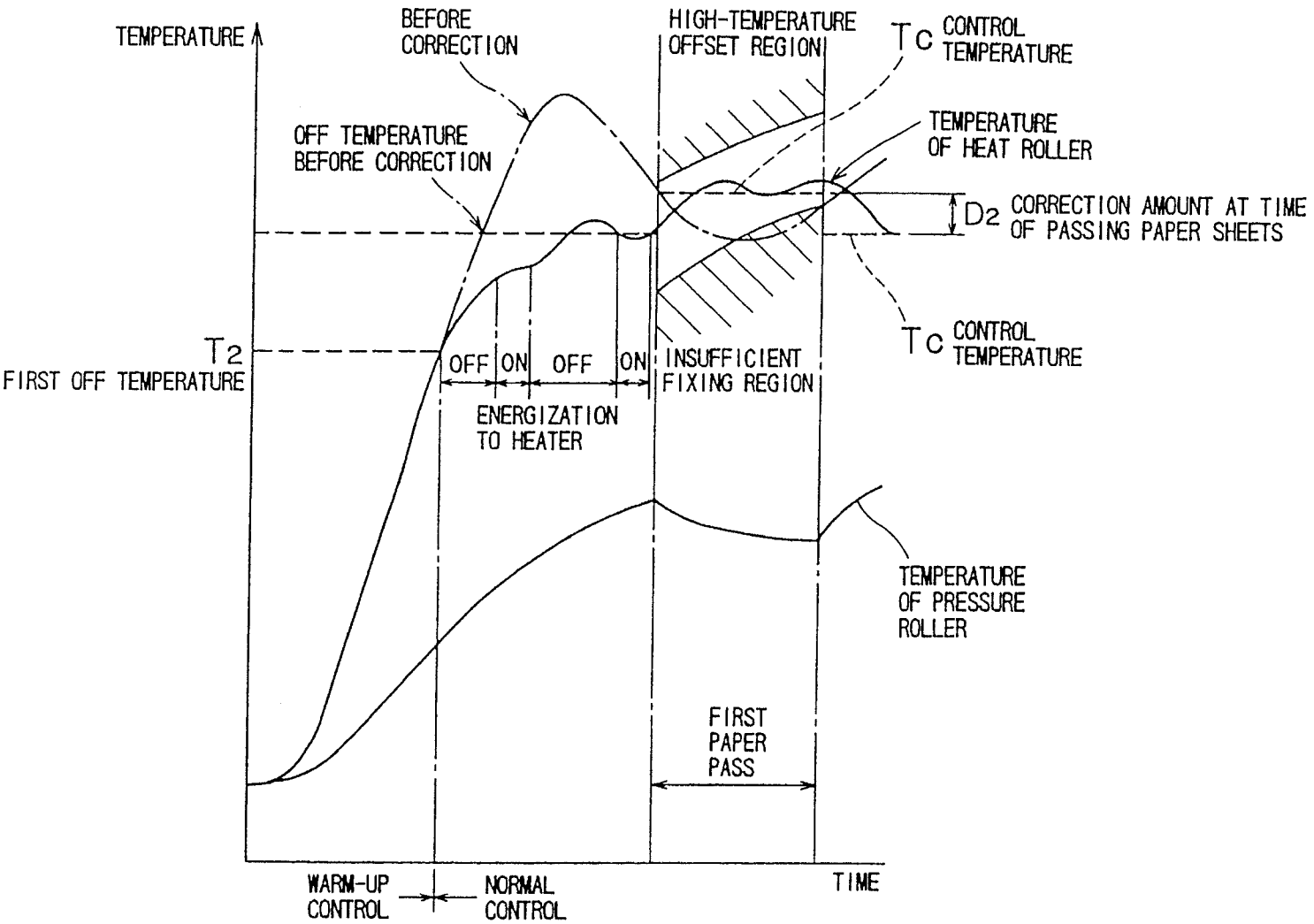
FIG. 7 is a diagram showing the change with time of the temperatures of the heat roller and the pressure roller in the stage of transition from warm-up control to normal control.
Figure 8:
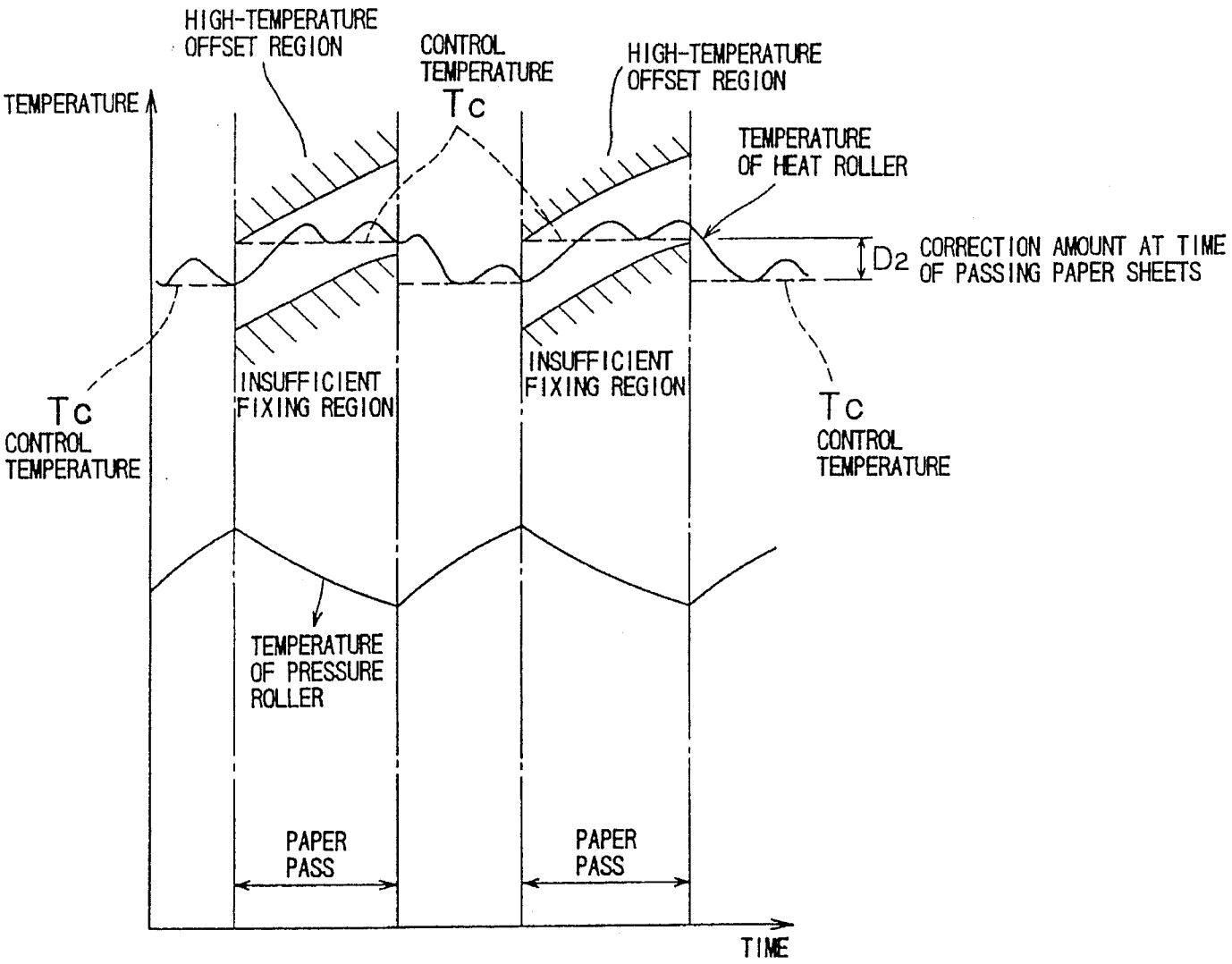
FIG. 8 is a diagram showing the change with time of the temperatures of the heat roller and the pressure roller in a time region including the time when paper sheets pass.

Description is now made of operations in a case where such control is carried out with reference to FIGS. 3 to 5 which are flow charts and FIGS. 6 to 8 showing the change with time of the temperatures of the heat roller 54*a* and the pressure roller 54*b*.

The steps S1 to S11 show the flow of the processing in the warm-up control mode. If the processing in the warm-up control mode is started in response to input of a copying start signal by depressing the copying starting switch 10*a*, initialization for clearing the preceding data such as detected temperatures $t_0$ and $t_1$ to $t_3$ is first carried out (step S1), the initial temperature $t_1$ of the heat roller 54*a* is read on the basis of a signal from the heat roller temperature detecting sensor SH (step S2), and the heater 59 is turned on (step S3), after which a timer is reset to start counting (steps S4 and S5).

In the steps S6 to S10, the detected temperature $t_2$ of the heat roller 54*a* is monitored, to turn the heater 59 off if the detected temperature $t_2$ of the heat roller 54*a* reaches a first off temperature $t_2$ (steps S10 and S11, see FIG. 7), after which the processing in the warm-up control mode is terminated. On the other hand, in a case where the detected temperature $t_2$ of the heat roller 54*a* does not reach the first off temperature $T_2$ even if a predetermined time has elapsed since the heater 59 was turned on (which is judged depending on whether or not the value of the count C of the timer is not less than a predetermined value $C_1$), it is judged that an abnormality occured (steps S7 and S8), whereby it is indicated that an abnormality occured on the operating section 10 of the copying machine, for example.

Since the first off temperature $T_2$ is set lower than a control temperature $T_c$ in the normal control mode as described later, it is possible to decrease the amount of overshoot toward the temperature rise, as shown in FIG. 7. As a result, it is possible to restrain overshoot toward the temperature drop after the first time the heater 59 was turned off. Moreover, intermittent control based on the elapsed time and the control temperature $T_c$ is carried out as described later, thereby to make it possible to carry out temperature control in a state where a high-temperature offset region and an insufficient fixing region are avoided at the time of making the first copy. Particularly with respect to copying in the stage of transition from the warm-up control to the normal control in which the temperature change is liable to be violent, it is possible to avoid both high-temperature offset in the front ends of the paper sheets and insufficient fixing in the rear ends of the paper sheets. In FIG. 7, the temperature change in a case where the first off temperature is not decreased is indicated by a one-dot and dash line for comparison, in which both the amounts of overshoot toward the temperature rise and toward the temperature drop are large.

The steps S12 to S36 then show the flow of processing in the normal control mode. First, the timer is reset to start counting, to store the number of times of energization n=1 to the heater 59 (steps S12 and S14). In the step S15, it is judged whether or not a copying termination signal exists. If the copying termination signal is inputted, it is confirmed that the heater is turned off, after which the processing is terminated (steps S16 and S17). Cases where the copying termination signal is outputted also include a case where the copying machine is stopped due to an abnormality of the copying machine in addition to a case where copies whose number is set in the operating section 10 are terminated.

If the copying termination signal is not inputted, the processing in the normal control mode is continued. An initial correction amount $D_1(n)$ is added to a control temperature $T_3$ initialized under the condition that the initially detected temperature $t_1$ of the heat roller 54*a* detected at the time of starting the processing in the warm-up control mode is lower than a predetermined initially detected temperature $T_1$, and the result of the addition is taken as a control temperature $T_c$ (steps S18 and S19). This is for increasing the control temperature $T_c$ to prevent the insufficient fixing in the early stages of the processing in the normal control mode in which the pressure roller 54*b* is liable to be insufficiently warmed. Further, it is assumed that when the initially detected temperature $t_1$ of the heat roller 54*a* is high, the temperature of the pressure roller 54*b* is also high. In this case, no correction is made. Consequently, it is possible to prevent the fixing temperature from being too high by an unnecessary correction.

The above described initial correction amount $D_1(n)$ is so functionally set as to be decreased to zero depending on the number of times of energization n to the heater 59. This is for conforming to the idea that the temperature of the pressure roller 54*b* is gradually increased to converge at a predetermined temperature as a time has elapsed since the processing in the normal control mode was started. Consequently, it is possible to prevent the pressure roller 54*b* from being increased to an unnecessary high temperature.

In the steps S20 and 21, a predetermined correction amount at the time of passing paper sheets $D_2$ is then further added to the control temperature $T_c$ under the condition that paper sheets pass (paper sheets exist in the fixing device 54). A time region from the time when the paper discharge detecting switch 58 is turned on to the time when a predetermined time (for example, 3 seconds) has elapsed since the paper feeding detecting switch 57 was turned off is judged to be the time when paper sheets pass.

The following advantages are obtained by thus increasing the control temperature $T_c$ only when paper sheets pass. Specifically, when the heat capacity of the heat roller 54*a* is set small, the heat of the pressure roller 54b is removed by the paper sheets passing, which may result in insufficient fixing in the rear ends of the paper sheets. Therefore, it is considered that the control temperature $T_c$ is made always high. In such a case, high-temperature offset occurs in the front ends of the paper sheets. On the other hand, as shown in FIGS. 6 and 8, the control temperature $T_c$ is set high only when paper sheets pass, thereby to make it possible to prevent both the high-temperature offset in the front ends of the paper sheets and the insufficient fixing in the rear ends of the paper sheets. Specifically, when the front ends of the paper sheets pass, the control temperature $T_c$ has been set low until this time when the paper sheets pass. Accordingly, the temperature of the heat roller 54a is decreased, thereby to make it possible to prevent the high-temperature offset. On the other hand, when the rear ends of the paper sheets pass, the temperature of the heat roller 54a is increased, thereby to make it possible to prevent the insufficient fixing.

On the other hand, the predetermined correction amount at the time of passing paper sheets $D_2$ can be set as $D_2(x)$ and so functionally set as to be increased depending on the elapsed time x since the paper sheets stared to pass (the paper discharge detecting switch was turned on). Consequently, higher-precision temperature control can be carried out when the paper sheets pass, thereby to make it possible to reliably prevent the high-temperature offset and the insufficient fixing.

In the steps S22 and S23, the atmospheric temperature $t_O$ detected by the atmospheric temperature detecting sensor SA is then read, and an environmental correction amount $D_3(t_O)$ corresponding to the atmospheric temperature $t_O$ is further added to the control temperature $T_c$. Consequently, the following advantages are obtained. Specifically, when the atmospheric temperature $t_O$ is low, the temperature of the paper sheets is also low, so that the amount of heat removed from the pressure roller 54b by the paper sheets is large. This conceivably prevents stable temperature control. Accordingly, the control temperature $T_c$ is corrected depending on the atmospheric temperature $t_O$, thereby to carry out stable temperature control.

It is then confirmed that the heater 59 is turned off (step S24), after which two conditions, that is, the condition (1) that the elapsed time since the first time the heater 59 was turned off (or since the heater 59 was turned off last time) is not less than a predetermined time (for example, 2 seconds) (the value of the count C by the timer is not less than a predetermined value $C_{OFF}$), and the condition (2) that the detected temperature $t_3$ of the heat roller 54a is lower than the control temperature $T_c$ are monitored in the steps S25 and S28. The heater 59 is not turned on until both the conditions are satisfied (step S29). A state where the heater 59 is turned off is continued for at least two seconds. Thereafter, the timer is reset (step S30), after which the program is returned to the step S15 to repeat the processing.

In a state where the heater 59 is turned on, two conditions, that is, the condition (1) that the elapsed time since the heater 59 was turned on last time reaches a predetermined time (for example, one second) (the value of the count C by the timer is not less than a predetermined value $C_{ON}$), and the condition (2) that the detected temperature $t_3$ of the heat roller 54a is higher than the control temperature $T_c$ are monitored in the steps S31 to S34. The heater 59 is not turned off until either one of the conditions is satisfied (step S35). Consequently, a state where the heater 59 is turned on is continued for a maximum of one second. Thereafter, the number of times of energization n to the heater 59 is replaced with (n+1) to reset the timer (steps S36 and 30), after which the program is returned to the step S15 to repeat the processing.

In the normal control in which the step S15 and the subsequent steps are repeated in the above described manner, the energization to the heater 59 is intermittently controlled by combining the ON time or the OFF time and the control temperature $T_c$, to restrain variations in temperature. Further, in the early stages of the processing in the normal control mode, the control temperature $T_c$ is corrected to a higher temperature, and the control temperature $T_c$ is further corrected to a higher temperature only when the paper sheets pass. Moreover, a correction corresponding to the atmospheric temperature $t_O$ is made. Consequently, it is possible to carry out more stable temperature control. If copying is terminated, the heater 59 remains off if it is off, while being turned off if it is on, to terminate the processing. Thereafter, the copying machine waits for the next copying.

As described in the foregoing, according to the present embodiment, the following various superior effects are produced:

i) Energization control to the heater 59 is carried out only at the time of copying, to achieve energy saving. Further, after the warm-up and in the early stages of the processing in the normal control mode in which the pressure roller 54b is liable to be insufficiently warmed, the control temperature $T_c$ is set by adding an initial correction amount $D_1(n)$, thereby to make it possible to prevent the insufficient fixing. Although in the above described embodiment, it is judged on the basis of the detected temperature of the heat roller 54a whether or not an initial correction is made, the judgment may be made on the basis of the temperature of the pressure roller 54b by the pressure roller temperature detecting means and the atmospheric temperature by the atmospheric temperature detecting means SA.

ii) Furthermore, the initial correction amount $D_1(n)$ is gradually decreased as the number of times of energization n to the heater 59 is increased. Consequently, it is possible to prevent the pressure roller 54b from being increased to an unnecessary high temperature. Therefore, it is possible to prevent the high-temperature offset.

iii) Moreover, the above described initial correction is made only when the detected temperature $t_1$ of the heat roller 54a before the first time the heater 59 was turned on is low, while not being made when it is high. Consequently, it is possible to prevent the fixing temperature from being made too high by an unnecessary initial correction.

iv) Since the control temperature is set high only when the paper sheets pass, it is possible to prevent both the high-temperature offset in the front ends of the paper sheets and the insufficient fixing in the rear ends of the paper sheets, thereby to achieve good fixing. In addition, $D_2(x)$ is employed as the above described correction amount at the time of passing paper sheets $D_2$. The correction amount $D_2(x)$ is so functionally set as to be increased depending on the elapsed time x since the paper discharge detecting switch was turned on, so that higher-precision temperature control can be carried out when the paper sheets pass, thereby to make it possible to reliably prevent the high-temperature offset and the insufficient fixing.

In the above described embodiment, the correction amount at the time of passing paper sheets $D_2$ can be set as $D_2(t_O)$ depending on the atmospheric temperature $t_O$. Alternatively, the correction amount at the time of passing paper sheets $D_2$ can be also set as $D_2(t_0,x)$ by adding both the elapsed time x and the atmospheric temperature $t_O$.

v) Since the first off temperature $t_2$ is set lower than the control temperature $T_c$ in the normal control mode by a predetermined amount $D_O$, thereby to make it possible to reduce the amount of overshoot toward the temperature rise and consequently, to reduce the subsequent amount of overshoot toward the temperature drop. Consequently, the variations in temperature can be restrained to introduce the temperature of the heat roller 54*a* into a desired temperature region, thereby to make it possible to prevent the high-temperature offset and wrinkle which are liable to be caused in the front ends of the paper sheets and the insufficient fixing which is caused in the rear ends of the paper sheets in the first image formation.

vi) Moreover, at the time of the normal control mode after the warm-up, intermittent control using a combination of the on duration or the off duration and the control temperature is carried out. Consequently, the variations in temperature can be further restrained to introduce the temperature of the heat roller 54*a* into a desired temperature region, thereby to make it possible to more reliably prevent the high-temperature offset and the insufficient fixing.

vii) Such a correction is made that when the atmospheric temperature $t_O$ at which it is considered that the temperature of the paper sheets is low, the control temperature $T_c$ is increased. Consequently, stable temperature control can be carried out, thereby to make it possible to prevent the high-temperature offset and the insufficient fixing which are caused by the environmental temperature, that is, the initial temperature of the paper sheets.

Second Embodiment

Figure 9:
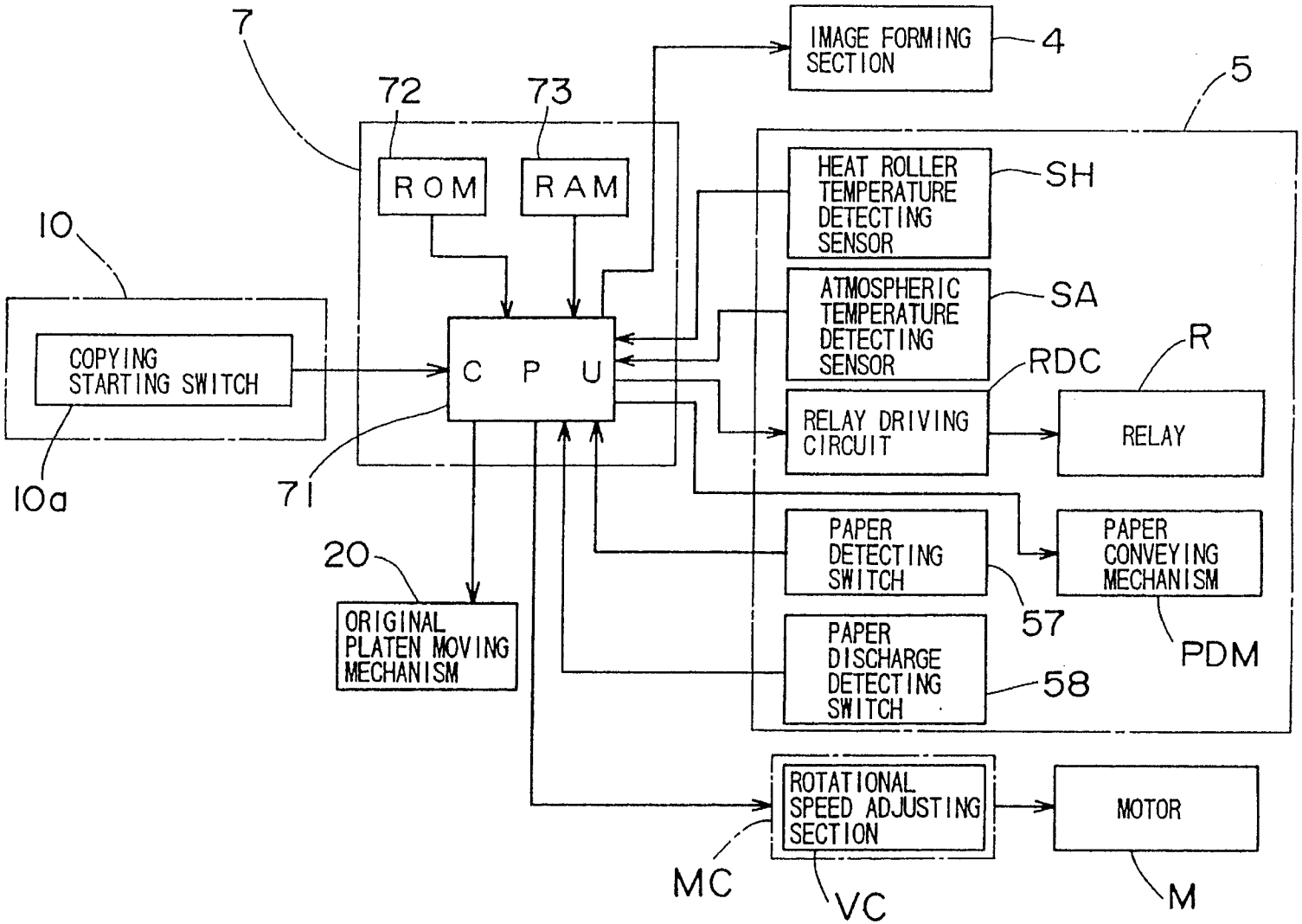
FIG. 9 is a block diagram showing the electrical construction of a copying machine comprising a fixing temperature control device according to a second embodiment of the present invention.

FIG. 9 shows another embodiment of the present invention. Referring to FIG. 9, the present embodiment is characterized in that a rotational speed adjusting section VC for adjusting the rotational speed of a motor M depending on an atmospheric temperature detected by an atmospheric temperature detecting sensor SA is provided inside a motor driving circuit MC. The speeds of an original platen moving mechanism 20, an image forming section 4 and a paper conveying mechanism PDM are all adjusted in the same manner by adjusting the rotational speed. Known speed adjusting circuits such as a speed adjusting circuit of a tap-switching type in which a plurality of taps which differ in the coil winding number are switched to vary a current applied to the motor M can be employed as the rotational speed adjusting section VC.

In the present embodiment, if the atmospheric temperature detected by the atmospheric temperature detecting sensor SA is low, it is assumed that the temperature of paper sheets is also low, to make such adjustment that the speed of paper conveyance is decreased by the speed adjusting section VC. Conversely, if the atmospheric temperature is high, it is assumed that the temperature of paper sheets is also high, to make such adjustment that the speed of paper conveyance is increased. The speed at which paper sheets pass is thus adjusted depending on the atmospheric temperature, thereby to make it possible to adjust the amount of heat per unit time removed by the paper sheets to maintain a balance with the amount of heat per unit time supplied by the heater 59. Consequently, stable temperature control can be carried out, thereby to make it possible to prevent high-temperature offset and insufficient fixing which are caused by an environmental temperature.

Third Embodiment

Description is made of a third embodiment of the present invention with reference to FIGS. 10 to 16.

Figure 10:
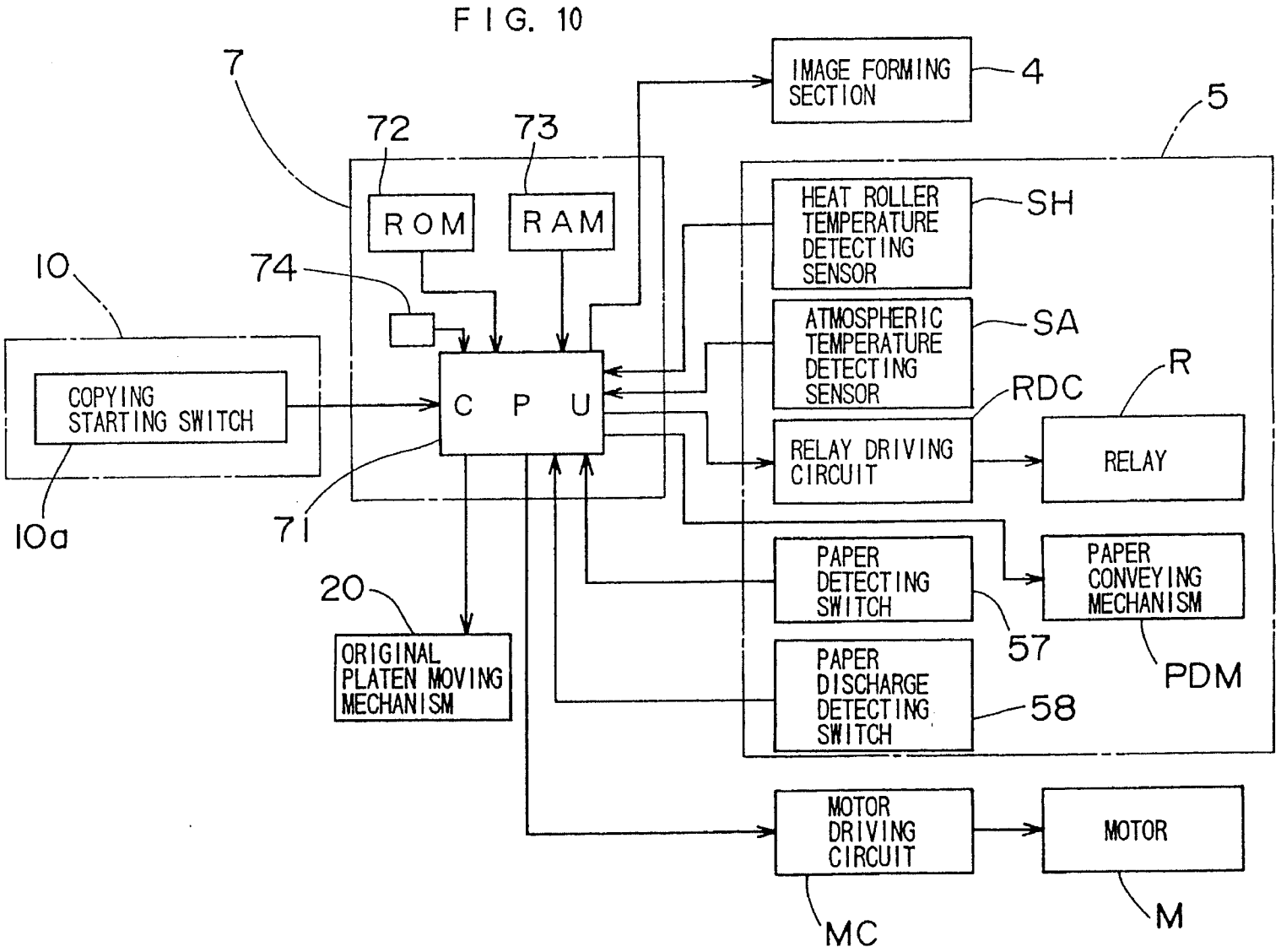
FIG. 10 is a block diagram showing the electrical construction of a copying machine comprising a fixing temperature control device according to a third embodiment of the present invention.

Referring to FIG. 10, the present embodiment differs in the electrical construction from the embodiment shown in FIG. 1 in that a nonvolatile memory 74 for storing, for example, the number of times of energization to the heater 59 at the time of the termination of image formation is provided in a control section 7. In addition, the present embodiment differs from the embodiment shown in FIG. 1 in operations for temperature control. Control operations according to the present embodiment will be described with reference to FIGS. 11 to 16.

Figure 11:
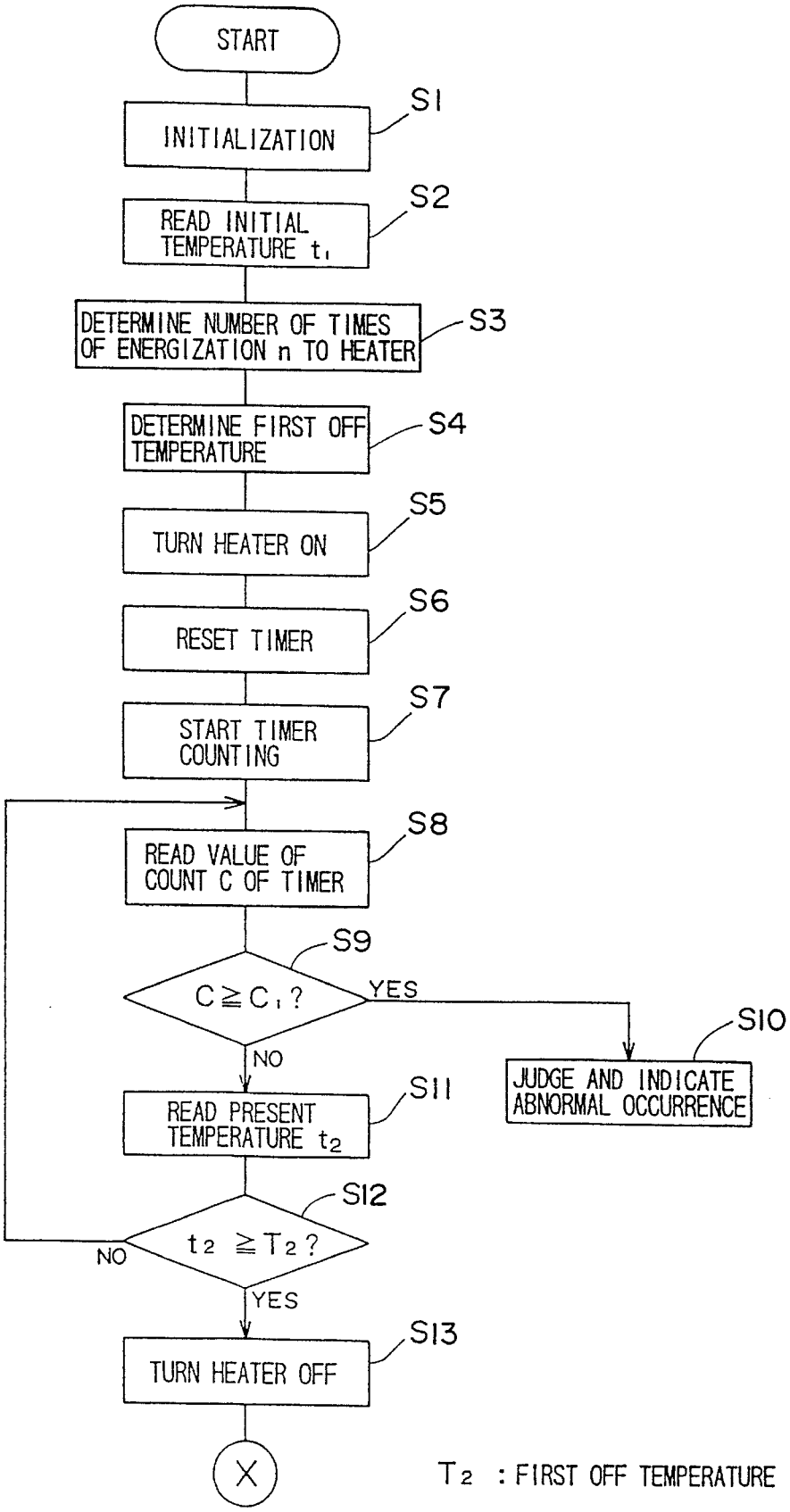
FIG. 11 is a flow chart showing operations in a warm-up control mode out of operations for temperature control.
Figure 12:
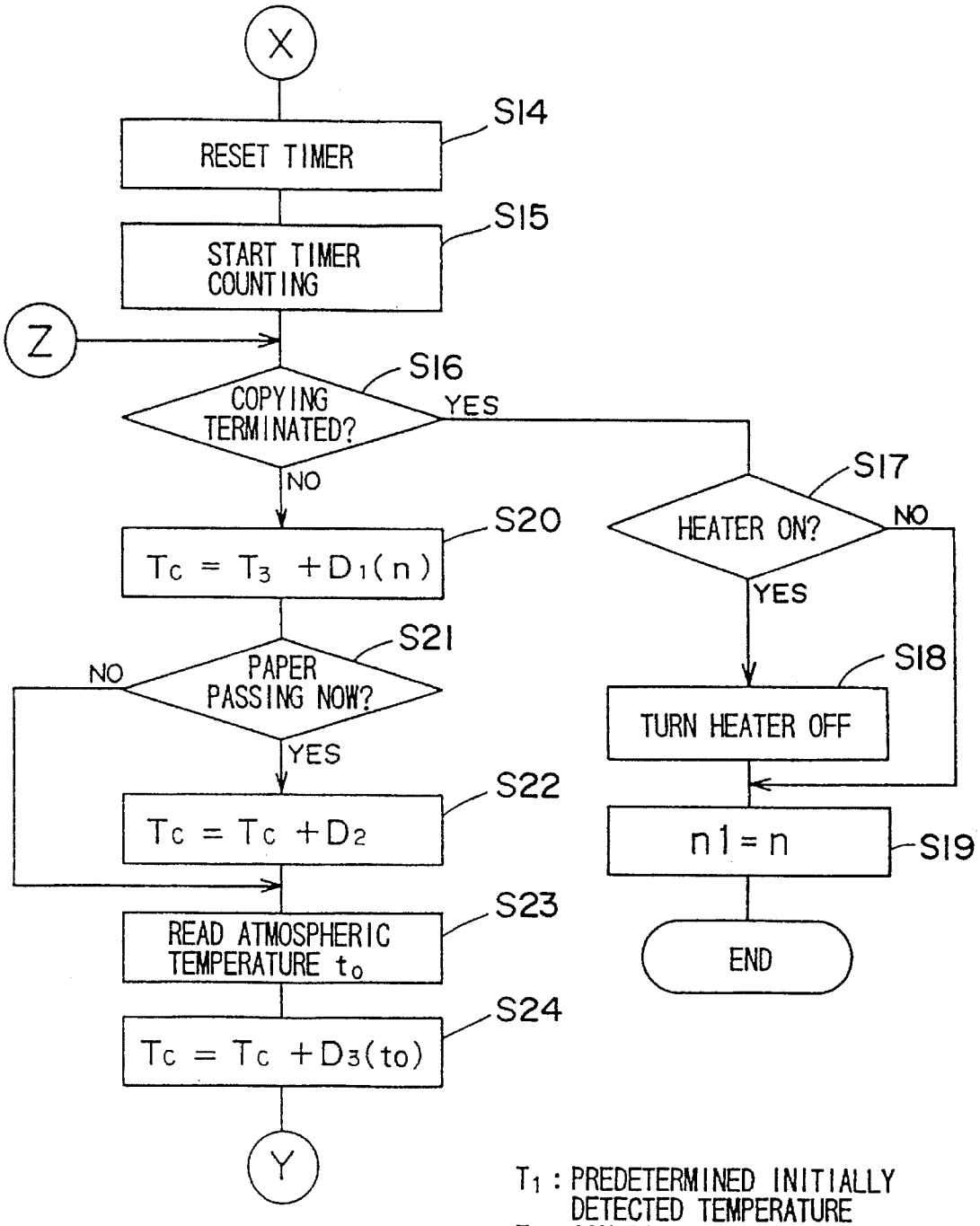
FIG. 12 is a flow chart showing operations in a normal control mode out of the operations for temperature control.
Figure 13:
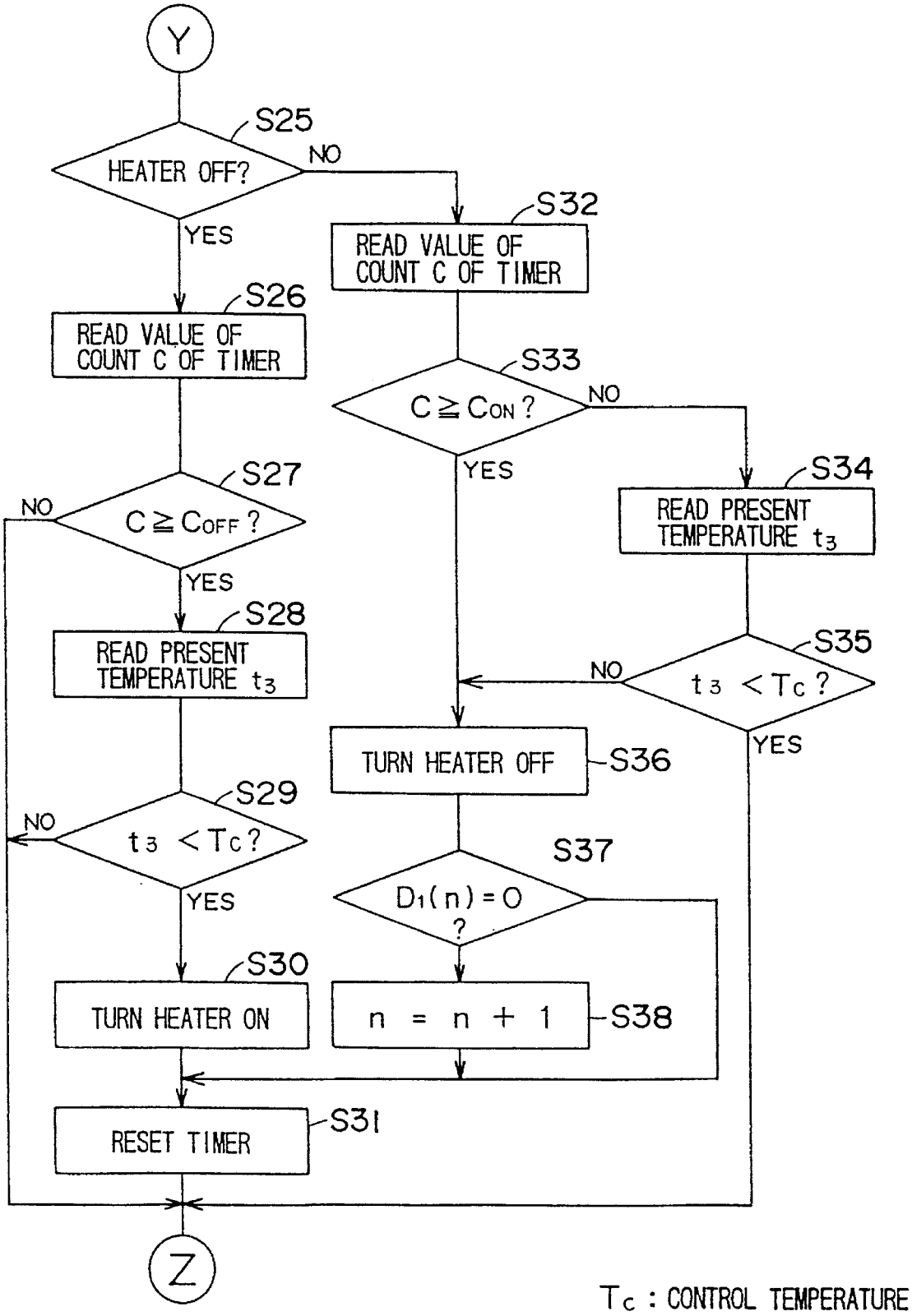
FIG. 13 is a flow chart showing operations in the normal control mode out of the operations for temperature control, which is a continuation of the flow chart of FIG. 12.

Referring to FIG. 11, the steps S1 to S13 show the flow of processing in a warm-up control mode. If the processing in the warm-up control mode is started in response to input of a copying start signal by depressing a copying starting switch 10*a*, initialization for cleaning the preceding data such as detected temperatures $t_O$ and $t_1$ to $t_3$ is first carried out (step S1), and the initial temperature $t_1$ of a heat roller 54*a* is read on the basis of a signal from a heat roller temperature detecting sensor SH (step S2).

Figure 14:
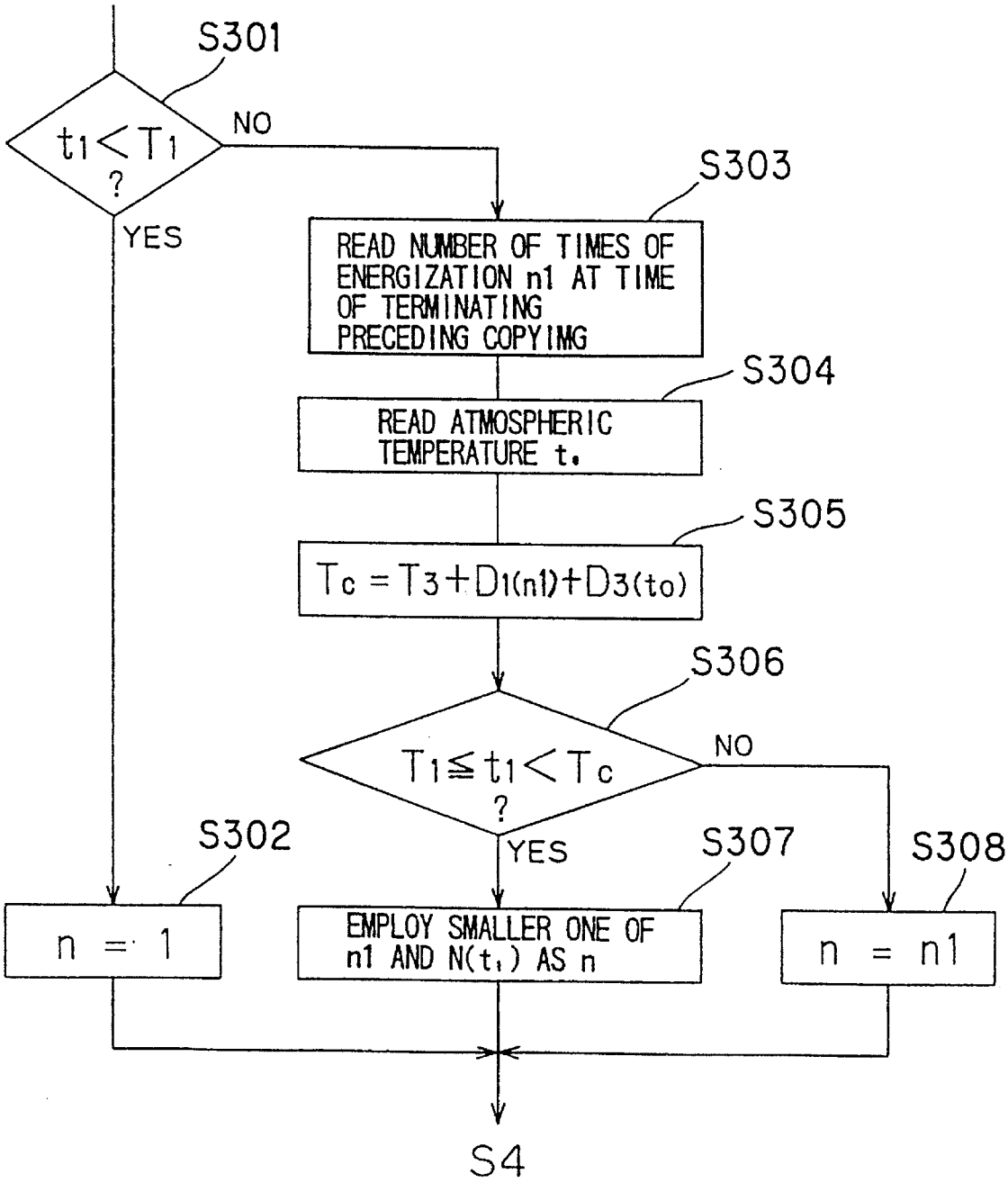
FIG. 14 is a flow chart showing the flow for determining the number of times of energization n to a heater.

In the step S3, the number of times of energization n to the heater is then determined. Referring to FIG. 14, description is made of processing in the step S3. If the initial temperature $t_1$ is lower than a predetermined temperature $T_1$ in the step S301, the initial value of the number of times of energization n is set to 1 (step S302). This is for making a normal correction because when the initial temperature $t_1$ of the heat roller 54*a* is low, it is assumed that the temperature of the pressure roller 54*b* is also low.

On the other hand, if the initial temperature $t_1$ is not less than the predetermined temperature $T_1$ in the step S301, the value of the number of times of energization n1 at the time of terminating the preceding copying which is stored in the nonvolatile memory 74 is read out (step S303), and the atmospheric temperature $t_O$ is read (step S304). Further, a temporary control temperature $T_c$ is found by adding an initial correction amount $D_1$(n1) and an environmental correction amount $D_3(t_O)$ to an initial control temperature $T_3$ (step S305). If the initial temperature $t_1$ is not less than the found control temperature $T_c$ in the step S306, the value of the number of times of energization n1 to the heater at the time of terminating the preceding copying is taken as the initial value of the number of times of energization n integrated this time (step S308). This is for making a correction as a continuation of the preceding initial correction because it is assumed that the temperature of a pressure roller 54*b* is hardly decreased after the preceding copying if the initial temperature $t_1$ is not less than the control temperature $T_c$.

On the other hand, if the initial temperature $t_1$ is less than the control temperature $T_c$ at the time of terminating the preceding image formation in the step S306, the smaller one of the value of the number of times of energization n1 to the heater at the time of terminating the preceding copying and a value $N(t_1)$ corresponding to the initial temperature $t_1$ is employed as the initial value of the number of times of energization n integrated this time (step S307). The value $N(t_1)$ is so set as to be increased as $t_1$ is increased. At the time of starting the second copying shown in FIG. 16, the number of times of energization n1 to the heater at the time of terminating the preceding copying is employed as the initial value.

In the step S4, a predetermined amount $D_O$ (for example, 20° C.) is subtracted from the control temperature $T_c$ found on the basis of the initial value of the number of times of energization n found in the step S3, thereby to determine a first off temperature $T_2$. That is, the first off temperature $T_2$ is set by an equation of $T_2=T_3+D_1(n)+D_3(t_O)-D_O$.

The heater 59 is then turned on (step S5), after which a timer is reset to start counting (steps S6 and S7).

In the steps S8 to S12, the detected temperature $t_2$ of the heat roller 54*a* is monitored, to turn the heater 59 off if the detected temperature $t_2$ of the heat roller 54*a* reaches the first off temperature $T_2$ (steps S12 and S13, see FIG. 16), after which the processing in the warm-up control mode is terminated. On the other hand, in a case where the detected temperature $t_2$ of the heat roller 54*a* does not reach the first off temperature $T_2$ even if a predetermined time has elapsed since the heater 59 was turned on (which is judged depending on whether or not the value of the count C of the timer is not less than a predetermined value $C_1$), it is judged that an abnormality occurred (steps S9 and S10), whereby it is indicated that an abnormality occured on an operating section 10 of the copying machine, for example.

Figure 16:
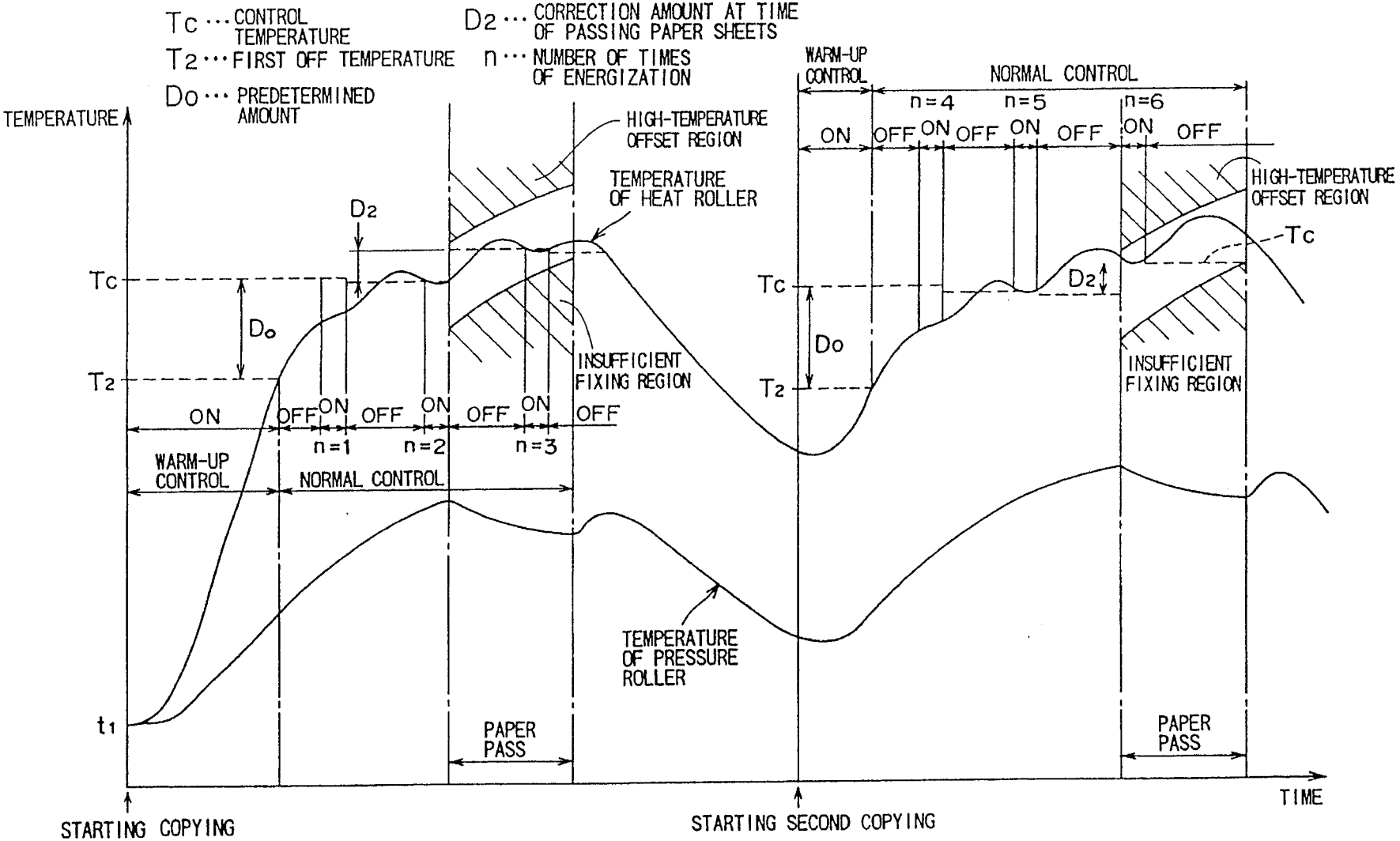
FIG. 16 is a diagram showing in detail the change with time of the temperatures of the heat roller and the pressure roller.

Since the first off temperature $T_2$ is set lower than the control temperature $T_c$ by a predetermined amount $D_O$, it is possible to decrease the amount of overshoot toward the temperature rise, as shown in FIG. 16. As a result, it is possible to restrain overshoot toward the temperature drop after the first time the heater 59 was turned on. Moreover, intermittent control based on the elapsed time and the control temperature $T_c$ is carried out as described later, thereby to make it possible to carry out temperature control in a state where a high-temperature offset region and an insufficient fixing region are avoided at the time of making the first copy.

Figure 15:
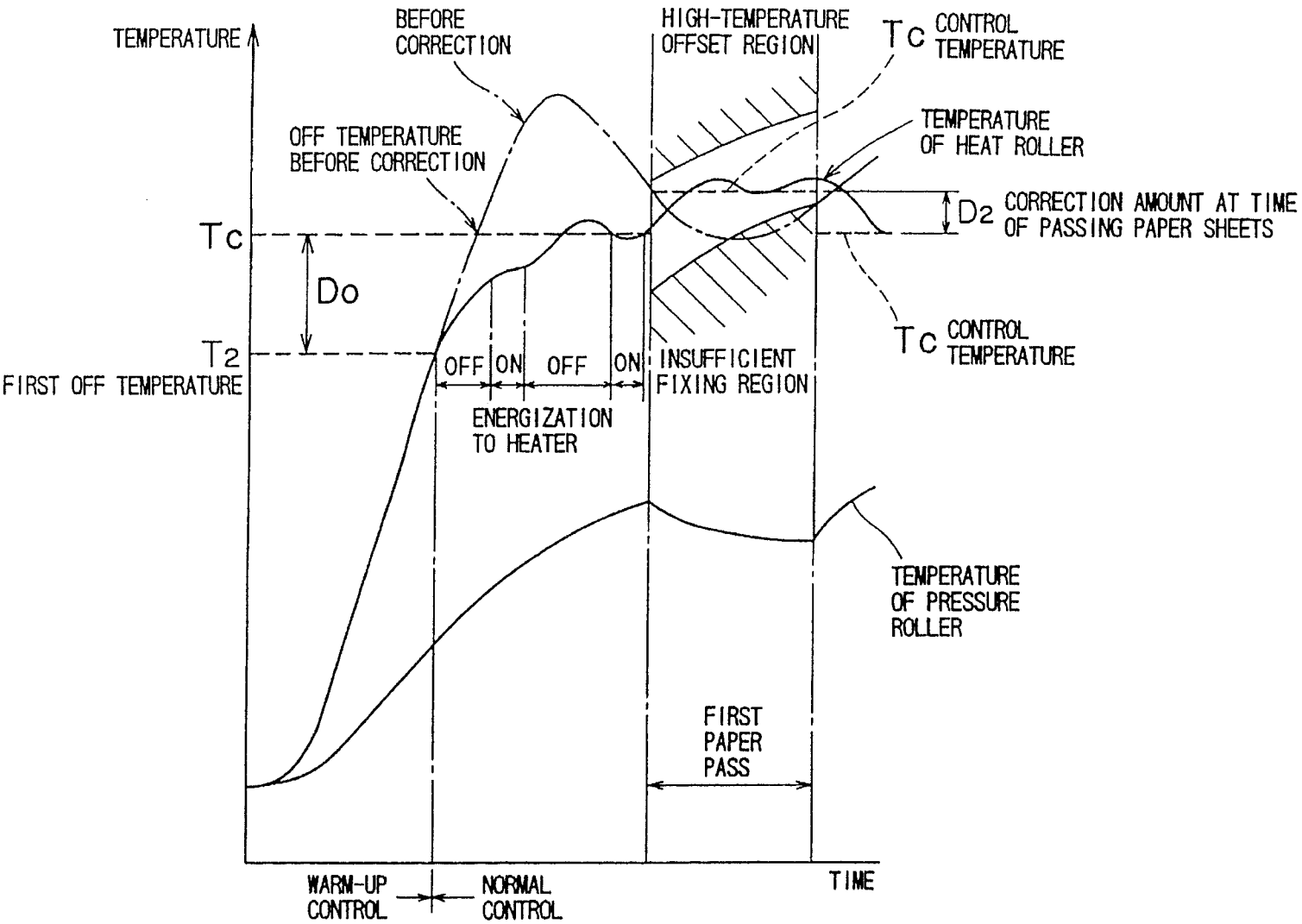
FIG. 15 is a diagram showing the change with time of the temperatures of a heat roller and a pressure roller in the stage of transition from warm-up control to normal control.

Particularly with respect to copying in the stage of transition from the warm-up control to the normal control in which the temperature change is liable to be violent, it is possible to avoid high-temperature offset in the front ends of the paper sheets and insufficient fixing in the rear ends of the paper sheets. In addition, also at the time of starting the second copying as shown in FIG. 16, the first off temperature $T_2$ is set depending on the control temperature $T_c$ which will be controlled. Even when copying is repeated a plurality of times, therefore, it is possible to more reliably prevent the high-temperature offset and the insufficient fixing. In FIG. 15, the temperature change in a case where the first off temperature is not decreased is indicated by a one-dot and dash line for comparison, in which both the amounts of overshoot toward the temperature rise and toward the temperature drop are large.

The steps S14 to S38 then show the flow of processing in the normal control mode. First, the timer is reset to start counting (steps S14 and S15). In the step S16, it is judged whether or not a copying termination signal exists. If the copying termination signal is inputted, it is confirmed that the heater 59 is turned off and then, the number of times of energization n found so far is stored as the preceding number of times of energization n1 in the nonvolatile memory 74, after which the processing is terminated (steps S17 to S19). Cases where the copying termination signal is outputted also include a case where the copying machine is stopped due to an abnormality of the copying machine in addition to a case where copies whose number is set in the operating section 10 are terminated.

If the copying termination signal is not inputted in the step S16, the processing in the normal control mode is continued. A correction amount $D_1(n)$ is added to a control temperature $T_3$ initialized, and the result of the addition is taken as a control temperature $T_c$ (step S20). This is for increasing the control temperature $T_c$ to prevent the insufficient fixing in the early stages of the processing in the normal control mode in which the pressure roller 54*b* is liable to be insufficiently warmed.

The above described correction amount $D_1(n)$ is so functionally set as to be decreased to zero depending on the number of times of energization n to the heater 59. This is for conforming to the idea that the temperature of the pressure roller 54*b* is gradually increased to converge at a predetermined temperature as time elapses since the processing in the normal control mode was started. Consequently, it is possible to prevent the pressure roller 54*b* from being increased to an unnecessary high temperature.

In the steps S21 and 22, a predetermined correction amount at the time of passing paper sheets $D_2$ is then further added to the control temperature $T_c$ under the condition that paper sheets pass (paper sheets exist in the fixing device 54). A time region from the time when the paper discharge detecting switch 58 is turned on to the time when a predetermined time (for example, 3 seconds) has elapsed since the paper discharge detecting switch 58 was turned off is judged to be the time when paper sheets pass.

The following advantages are obtained by thus increasing the control temperature $T_c$ only when paper sheets pass. Specifically, when the heat capacity of the heat roller 54*a* is set small, the heat of the pressure roller 54*b* is removed by the paper sheets passing, which may result in the insufficient fixing in the rear ends of the paper sheets. Therefore, it is considered that the control temperature $T_c$ is high. In such a case, high-temperature offset occurs in the front ends of the paper sheets. On the other hand, as shown in FIGS. 16, the control temperature $T_c$ is set high only when paper sheets pass, thereby to make it possible to prevent both the high-temperature offset in the front ends of the paper sheets and the insufficient fixing in the rear ends of the paper sheets. Specifically, when the front ends of the paper sheets pass, the control temperature $T_c$ has been set low until this time when the paper sheets pass. Accordingly, the temperature of the heat roller 54*a* is decreased, thereby to make it possible to prevent the high-temperature offset. On the other hand, when the rear ends of the paper sheets pass, the temperature of the heat roller 54*a* is increased, thereby to make it possible to prevent the insufficient fixing.

On the other hand, the predetermined correction amount at the time of passing paper sheets $D_2$ can be set as $D_2(x)$ and so functionally set as to be increased depending on the elapsed time x since the paper sheets started to pass (since the paper discharge detecting switch was turned on). Consequently, higher-precision temperature control can be carried out when the paper sheets pass, thereby to make it possible to reliably prevent the high-temperature offset and the insufficient fixing.

In the steps S23 and S24, the atmospheric temperature $t_O$ serving as an environmental temperature is then read, and an environmental correction amount $D_3(t_O)$ corresponding to the atmospheric temperature $t_O$ is further added to the control temperature $T_c$. Consequently, the following advantages are obtained. Specifically, when the atmospheric temperature $t_O$ is low, the temperature of the paper sheets is also low, so that the amount of heat removed from the pressure roller 54*b* by the paper sheets is large. This conceivably prevents stable temperature control. Accordingly, the control temperature $T_c$ is corrected depending on the atmospheric temperature $t_O$, thereby to carry out stable temperature control.

It is then confirmed that the heater 59 is turned off (step S25), after which two conditions, that is, the condition (1) that the elapsed time since the first time the heater 59 was turned off (or since the heater 59 was turned off last time) is not less than a predetermined time (for example, 2 seconds) (the value of the count C by the timer is not less than a predetermined value $C_{OFF}$), and the condition (2) that the detected temperature $t_3$ of the heat roller 54*a* is lower than the control temperature $T_c$ are monitored in the steps S26 and S29. The heater 59 is not turned on until both the conditions are satisfied (step S30). A state where the heater 59 is turned off is continued for at least two seconds. Thereafter, the timer is reset (step S31), after which the program is returned to the step S16 to repeat the processing.

In a state where the heater 59 is turned on in the step S25, two conditions, that is, the condition (1) that the elapsed time since the heater 59 was turned on reaches a predetermined time (for example, one second) (the value of the count C by the timer is not less than a predetermined value $C_{ON}$), and the condition (2) that the detected temperature $t_3$ of the heat roller 54*a* is higher than the control temperature $T_c$ are monitored in the steps S32 to S35. The heater 59 is not turned off until either one of the conditions is satisfied (step S36). Consequently, a state where the heater 59 is turned on is continued for a maximum of one second. Thereafter, the number of times of energization n to the heater 59 is replaced with (n+1) under the condition that the initial correction amount $D_1(n)$ is not zero (an initial correction is not terminated) (steps S37 and 38), to reset the timer (step S31), after which the program is returned to the step S16 to repeat the processing.

In the normal control in which the step S16 and the subsequent steps are repeated in the above described manner, the energization to the heater 59 is intermittently controlled by combining the ON time or the OFF time and the control temperature $T_c$, to restrain variations in temperature. In addition, in the early stages of the processing in the normal control mode, the control temperature $T_c$ is corrected to a higher temperature, and the control temperature $T_c$ is further corrected to a higher temperature only when the paper sheets pass. Moreover, a correction corresponding to the atmospheric temperature $t_O$ is made. Consequently, it is possible to carry out more stable temperature control. If copying is terminated, the heater 59 remains off if it is off, while being turned off if it is turned on, thereby to terminate the processing. Thereafter, the copying machine waits for the next copying.

According to the present embodiment, the following various superior effects are produced in addition the same effects as the effects described in the items i) to vii) in the embodiment shown in FIG. 1:

Image formation may, in some cases, be started again before only a short time has elapsed since an image was last time formed. It is considered that the temperature of the pressure roller 4*b* is still high when an image is formed this time. In a case where the initially detected temperature of the heat roller 54*a* is high in which it is assumed that the temperature of the pressure roller 54*b* is high, the accumulated number of times of energization to the heater 59 at the time of forming an image last time and the accumulated number of times of energization to the heater 59 at the time of forming an image this time are added, to decrease the initial correction amount as the accumulated number of times of energization, after the addition, is increased. Specifically, a normal correction amount is added when the initial temperature $t_1$ of the heat roller 54*a* before the first time the heater 59 was turned on is low, while an initial correction amount which is relatively small is added when the initial temperature $t_1$ is high, thereby to set the control temperature $T_c$. Consequently, it is possible to prevent the fixing temperature from being too high. As a result, it is possible to prevent the high-temperature offset, for example.

The present invention is not limited to the above described embodiments. The present invention can be subjected to various variations in the range in which the gist of the present invention is not changed. For example, the number of times of energization may be replaced with the accumulated energization time in the above described operation of the initial correction amount.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fixing temperature control device comprising:

a fixing device of an image forming apparatus which includes a heater, a pressure roller and a heat roller heated by said heater, said fixing device heating and fixing toner particles on paper sheets passing between both the rollers;

heat roller temperature detecting means for detecting the temperature of said heat roller; and energization control means for turning said heater on and off, wherein, said energization control means performs a warm-up mode and then a normal mode in response to each occurrence of an image formation start signal, wherein, in said warm-up control mode, warm-up mode processing is started by turning said heater on in response to said image formation start signal and is terminated by turning said heater off at a time when a temperature detected by said heat roller temperature detecting means reaches a predetermined first off temperature, and wherein, in said normal control mode, normal mode processing, having a predetermined control temperature as a target, is started on the basis of the temperature detected by said heat roller temperature detecting means upon termination of said warm-up mode processing of said warm-up control mode, and is terminated when said heater is turned off in response to an image formation termination signal, said heater remaining off until a next warm-up control mode is performed in response to a next image formation start signal.

2. The fixing temperature control device according to claim 1, wherein in said normal control mode, said predetermined control temperature is set by adding a required correction amount to a predetermined reference control temperature.

3. The fixing temperature control device according to claim 2, wherein said required correction amount includes an initial correction amount added in the early stages of the processing in the normal control mode.

4. The fixing temperature control device according to claim 2, wherein said correction amount includes a correction amount at the time of, passing paper sheets which is added with at least the time when the paper sheets pass between said rollers included.

5. The fixing temperature control device according to claim 2, further comprising environmental temperature detecting means for detecting an environmental temperature at which said fixing device is placed, said correction amount including an environmental correction amount added depending on the environmental temperature detected by the environmental temperature detecting means.

6. The fixing temperature control device according to claim 1, wherein said first off temperature is lower than said control temperature by a predetermined amount.

7. The fixing temperature control device according to claim 1, wherein in said normal control mode, the heater is turned on under the condition that the detected temperature of the heat roller is lower than said control temperature when a predetermined time has elapsed since the heater was turned off, and the heater is turned off when one of a first condition wherein a predetermined time has elapsed since the heater was turned on, and a second condition wherein the detected temperature of the heat roller is higher than said control temperature occurs.

8. A fixing temperature control device comprising:.

a fixing device of an image forming apparatus which includes a pressure roller and a heat roller heated by a heater and heats and fixes toner particles on paper sheets passing between both the rollers;

heat roller temperature detecting means for detecting the temperature of said heat roller; and energization control means for turning said heater on and off, said energization control means being set to a warm-up control mode in which warm-up mode processing is started by turning the heater on in response to input indicative of an image formation start signal, and in which warm-up mode processing is terminated by turning the heater off at a time when a temperature detected by said heat roller temperature detecting means reaches a predetermined first off temperature, and a normal control mode in which normal mode processing, having a predetermined control temperature as a target, is started on the basis of the temperature detected by said heat roller temperature detecting means in response to termination of the warm-up mode processing in the warm-up control mode, and in which normal mode processing is terminated when the heater is turned off in response to input of an image formation termination signal, wherein, in said normal control mode, said predetermined control temperature is set by adding a required correction amount to a predetermined reference control temperature, said required correction amount includes an initial correction amount added in the early stages of the processing in the normal control mode, and said initial correction amount is adjusted depending on a predetermined initial state amount associated with the temperature of the pressure roller which is obtained before the warm-up control mode is started.

9. The fixing temperature control device according to claim 8, wherein said initial correction amount is set to zero when said initial state amount obtained before the warm-up control mode is started is larger than a predetermined reference value.

10. The fixing temperature control device according to claim 8, wherein said predetermined initial state amount is a temperature initially detected by said heat roller temperature detecting means.

11. The fixing temperature control device according to claim 8, further comprising pressure roller temperature detecting means for detecting the temperature of said pressure roller, said predetermined initial state amount being a temperature initially detected by said pressure roller temperature detecting means.

12. The fixing temperature control device according to claim 8, further comprising environmental temperature detecting means for detecting an environmental temperature at which said fixing device is placed, said predetermined initial state amount being a temperature initially detected by said environmental temperature detecting means.

13. A fixing temperature control device comprising:

a fixing device of an image forming apparatus which includes a pressure roller and a heat roller heated by a heater and heats and fixes toner particles on paper sheets passing between both the rollers;

heat roller temperature detecting means for detecting the temperature of said heat roller; and energization control means for turning said heater on and off, said energization control means being set to a warm-up control mode in which warm-up mode processing is started by turning the heater on in response to input indicative of an image formation start signal, and in which warm-up mode processing is terminated by turning the heater off at a time when a temperature detected by said heat roller temperature detecting means reaches a predetermined first off temperature, and a normal control mode in which normal mode processing, having a predetermined control temperature as a target, is started on the basis of the temperature detected by said heat roller temperature detecting means in response to termination of the warm-up mode processing in the warm-up control mode, and in which normal mode processing is terminated when the heater is turned off in response to input of an image formation termination signal, wherein, in said normal control mode, said predetermined control temperature is set by adding a required correction amount to a predetermined reference control temperature, said required correction amount includes an initial correction amount added in the early stages of the processing in the normal control mode, and said initial correction amount is adjusted depending on a predetermined initial state amount associated with the temperature of the pressure roller which is obtained before the warm-up is started.

14. The fixing temperature control device according to claim 13, wherein said initial correction amount is set to zero when said initial state amount obtained before the warm-up control mode is started is larger than a predetermined reference value.

15. The fixing temperature control device according to claim 13, further comprising environmental temperature detecting means for detecting an environmental temperature at which said fixing device is placed, said predetermined initial state amount being a temperature initially detected by said environmental temperature detecting means.

16. A fixing temperature control device comprising:

a fixing device of an image forming apparatus which includes a pressure roller and a heat roller heated by a heater and heats and fixes toner particles on paper sheets passing between both the rollers;

heat roller temperature detecting means for detecting the temperature of said heat roller; and energization control means for turning said heater on and off, said energization control means being set to a warm-up control mode in which warm-up mode processing is started by turning the heater on in response to input indicative of an image formation start signal, and in which warm-up mode processing is terminated by turning the heater off at a time when a temperature detected by said heat roller temperature detecting means reaches a predetermined first off temperature, and a normal control mode in which normal mode processing, having a predetermined control temperature as a target, is started on the basis of the temperature detected by said heat roller temperature detecting means in response to termination of the warm-up mode processing in the warm-up control mode, and in which normal mode processing is terminated when the heater is turned off in response to input of an image formation termination signal, wherein, in said normal control mode, said predetermined control temperature is set by adding a required correction amount to a predetermined reference control temperature, said required correction amount includes an initial correction amount added in the early .stages of the processing in the normal control mode, and said initial correction amount is gradually decreased as an amount associated with an accumulated energization time to the heater since input of the image formation start signal is increased.

17. The fixing temperature control device according to claim 16, wherein an amount associated with the accumulated energization time to the heater is the number of times of energization of the heater.

18. The fixing temperature control device according to claim 16, wherein the energization control means decreases the initial correction amount as the sum of an amount associated with the accumulated energization time to the heater at the time of terminating the (m-1)-th image formation and an amount associated with the accumulated energization time to the heater since the m-th input of the image formation start signal is increased under the condition that the state amount associated with the temperature of the pressure roller before starting said warm-up control mode is not less than a predetermined reference value when processing is performed in response to the m-th input of the image formation start signal.

19. A fixing temperature control device comprising:

a fixing device of an image forming apparatus which includes a pressure roller and a heat roller heated by a heater and heats and fixes toner particles on paper sheets passing between both the rollers;

heat roller temperature detecting means for detecting the temperature of said heat roller; and energization control means for turning said heater on and off, said energization control means being set to a warm-up control mode in which warm-up mode processing is started by turning the heater on in response to input indicative of an image formation start signal, and in which warm-up mode processing is terminated by turning the heater off at a time when a temperature detected by said heat roller temperature detecting means reaches a predetermined first off temperature, and a normal control mode in which normal mode processing, having a predetermined control temperature as a target, is started on the basis of the temperature detected by said heat roller temperature detecting means in response to termination of the warm-up mode processing in the warm, up control mode, and in which normal mode processing is terminated when the heater is turned off in response to input of an image formation termination signal, wherein, in said normal control mode, said predetermined control temperature is set by adding a required correction amount to a predetermined reference control temperature, said correction amount includes a correction amount at the time of passing paper sheets which is added with at least the time when the paper sheets pass between said rollers included, said correction amount at the time of passing paper sheets is so adjusted that a correction amount at the time of passing paper sheets in a case where the rear ends of the paper sheets pass between the rollers is larger than a correction amount at the time of passing paper sheets in a case where the front ends of the paper sheets pass between the rollers.

20. A fixing temperature control device comprising:

a fixing device of an image forming apparatus which includes a pressure roller and a heat roller heated by a heater and heats and fixes toner particles on paper sheets passing between both the rollers;.

rotating and driving means for rotating and driving a group of a plurality of paper conveying rollers each comprising said pressure roller and said heat roller, environmental temperature detecting means for detecting an environmental temperature at which said fixing device is placed, a rotational speed adjusting section for adjusting the rotational speed of the rotating and driving means depending on the environmental temperature detected by said environmental temperature detecting means, heat roller temperature detecting means for detecting the temperature of said heat roller; and energization control means for turning said heater on and off, said energization control means being set to a warm-up control mode in which warm-Up mode processing is started by turning the heater on in response to input indicative of an image formation start signal, and in which warm-up mode processing is terminated by turning the heater off at a time when a temperature detected by said heat roller temperature detecting means reaches a predetermined first off temperature, and a normal control mode in which normal mode processing, having a predetermined control temperature as a target, is started on the basis of the temperature detected by said heat roller temperature detecting means in response to termination of the warm-up mode processing in the warm-up control mode, and in which normal mode processing is terminated when the heater is turned off in response to input of an image formation termination signal.

* * * * *